US009033599B2

(12) United States Patent
Kodama et al.

(10) Patent No.: US 9,033,599 B2
(45) Date of Patent: May 19, 2015

(54) PRINTING DEVICE WITH PRINT TIMING CONTROL BASED ON PAPERBOARD BASIS WEIGHT

(71) Applicant: Kabushiki Kaisha Isowa, Aichi (JP)

(72) Inventors: Junichi Kodama, Kasugai (JP); Tsutomu Okamoto, Kasugai (JP); Yusuke Tozuka, Kasugai (JP)

(73) Assignee: Kabushiki Kaisha Isowa, Aichi (JP)

( * ) Notice: Subject to any disclaimer, the term of this patent is extended or adjusted under 35 U.S.C. 154(b) by 0 days.

(21) Appl. No.: 13/952,336

(22) Filed: Jul. 26, 2013

(65) Prior Publication Data

US 2014/0037353 A1 Feb. 6, 2014

(30) Foreign Application Priority Data

Aug. 2, 2012 (JP) ..... 2012-172407

(51) Int. Cl.

| | |
|---|---|
| ***B41F 33/00*** | (2006.01) |
| ***B41F 13/56*** | (2006.01) |
| ***B41F 13/54*** | (2006.01) |
| ***B31B 1/88*** | (2006.01) |
| ***B31B 1/04*** | (2006.01) |
| ***B31B 1/20*** | (2006.01) |
| ***B41F 17/24*** | (2006.01) |
| ***B41F 1/04*** | (2006.01) |
| ***B31B 1/06*** | (2006.01) |
| ***B41F 13/02*** | (2006.01) |
| ***B41F 13/14*** | (2006.01) |

(52) U.S. Cl.

CPC ..... *B41F 17/24* (2013.01); *B31B 2201/95* (2013.01); *B31B 2201/0247* (2013.01); *B41F 13/56* (2013.01); *B41F 1/04* (2013.01); *B41F 33/0009* (2013.01); *B31B 1/88* (2013.01); *B31B 1/20* (2013.01); *B31B 1/06* (2013.01); *B41F 13/025* (2013.01); *B41F 13/14* (2013.01); *B41P 2213/90* (2013.01)

(58) Field of Classification Search

CPC ..... B31B 1/02; B31B 1/04; B31B 1/88; B31B 1/0234; B31B 2201/95; B41F 33/0009; B41F 13/12; B41F 13/14; B41F 13/025; B41F 13/56

See application file for complete search history.

(56) References Cited

U.S. PATENT DOCUMENTS

| | | | | |
|---|---|---|---|---|
| 5,036,764 | A * | 8/1991 | Rodi | 101/211 |
| 2001/0043816 | A1 * | 11/2001 | Dreher et al. | 399/45 |
| 2009/0193989 | A1 * | 8/2009 | Senoo | 101/219 |
| 2013/0184134 | A1 | 7/2013 | Suzuki et al. | |

FOREIGN PATENT DOCUMENTS

| | | | | |
|---|---|---|---|---|
| JP | 2001105573 | A * | 4/2001 | B41F 33/00 |
| JP | 2005014369 | A * | 1/2005 | B31B 1/20 |
| JP | 2012-011600 | A1 | 1/2012 | |

* cited by examiner

*Primary Examiner* — Daniel J Colilla

(74) *Attorney, Agent, or Firm* — Stroock & Stroock & Lavan LLP

(57) ABSTRACT

Provided is a corrugated paperboard sheet printing device which includes a conveyance device for conveying a corrugated paperboard sheet fed out from a sheet feeding device, while suckingly holding the sheet; a plurality of printing units for printing the sheet through a series of printing processes; an information generator for generating basis weight information indicative of a basis weight of a corrugated paperboard sheet in each order; a storage device for storing therein a plurality of correction information for correcting a plurality of printing timings at each of which a respective one of the plurality of printing units performs the printing process on the sheet, in association with the basis weight information; and a controller for, based on the correction information, correcting the printing timing in each of the printing units, and causing the printing unit to operate according to the corrected printing timing.

9 Claims, 6 Drawing Sheets

FIG.5

150

| PRINTING UNIT 4A | | | | | |
|---|---|---|---|---|---|
| | | SHEET LENGTH | | | |
| TOTAL BASIS WEIGHT | | ～450 | 451～900 | 901～1200 | 1201～ |
| | LL | 1 | 0 | 0 | 0 |
| | L | 1 | 0 | 0 | 0 |
| | M | 1 | 1 | 0 | 0 |
| | H | 2 | 1 | 1 | 0 |
| | HH | 3 | 2 | 2 | 1 |
| | HHH | 4 | 3 | 2 | 1 |

| PRINTING UNIT 4B | | | | | |
|---|---|---|---|---|---|
| | | SHEET LENGTH | | | |
| TOTAL BASIS WEIGHT | | ～450 | 451～900 | 901～1200 | 1201～ |
| | LL | 1 | 1 | 0 | 0 |
| | L | 1 | 1 | 0 | 0 |
| | M | 1 | 1 | 1 | 0 |
| | H | 2 | 2 | 2 | 1 |
| | HH | 5 | 3 | 3 | 2 |
| | HHH | 5 | 3 | 3 | 2 |

| PRINTING UNIT 4C | | | | | |
|---|---|---|---|---|---|
| | | SHEET LENGTH | | | |
| TOTAL BASIS WEIGHT | | ～450 | 451～900 | 901～1200 | 1201～ |
| | LL | 1 | 1 | 0 | 0 |
| | L | 2 | 1 | 0 | 0 |
| | M | 2 | 1 | 1 | 1 |
| | H | 4 | 3 | 3 | 2 |
| | HH | 7 | 5 | 4 | 3 |
| | HHH | 7 | 5 | 5 | 4 |

| SLOTTER DEVICE 6 | | | | | |
|---|---|---|---|---|---|
| | | SHEET LENGTH | | | |
| TOTAL BASIS WEIGHT | | ～450 | 451～900 | 901～1200 | 1201～ |
| | LL | 2 | 1 | 1 | 0 |
| | L | 2 | 1 | 1 | 0 |
| | M | 3 | 2 | 2 | 1 |
| | H | 5 | 4 | 4 | 3 |
| | HH | 10 | 7 | 6 | 4 |
| | HHH | 10 | 7 | 6 | 5 |

| DIE-CUTTER DEVICE 7 | | | | | |
|---|---|---|---|---|---|
| | | SHEET LENGTH | | | |
| TOTAL BASIS WEIGHT | | ～450 | 451～900 | 901～1200 | 1201～ |
| | LL | 2 | 1 | 1 | 0 |
| | L | 2 | 1 | 1 | 0 |
| | M | 3 | 2 | 2 | 1 |
| | H | 5 | 4 | 4 | 3 |
| | HH | 10 | 7 | 6 | 4 |
| | HHH | 10 | 7 | 6 | 5 |

PRINTING DEVICE WITH PRINT TIMING CONTROL BASED ON PAPERBOARD BASIS WEIGHT

TECHNICAL FIELD

The present invention relates to a corrugated paperboard sheet printing device which comprises: a conveyance device having a suction function for conveying, along a conveyance path, a corrugated paperboard sheet fed from a sheet feeding device; and a plurality of printing units arranged along the conveyance path to sequentially print the corrugated paperboard sheet through a series of printing processes.

BACKGROUND ART

Heretofore, there has been known a printing device for a corrugated paperboard sheet box making machine, wherein the printing device comprises a plurality of printing units for printing a corrugated paperboard sheet through a series of printing process, while the corrugated paperboard is conveyed from a sheet feeding device in a given conveyance direction. In this type of printing device, an actual printing position (i.e., actual position of a print pattern) on the corrugated paperboard sheet after performing the printing process by each of the printing units is likely to deviate with respect to a desired print position, in the conveyance direction. With a view to eliminating a deviation of printing position as the phenomenon that an actual print position deviates in the conveyance direction, a printing timing in each of the printing units has been adjusted according to a deviation amount of printing position. For adjusting the printing timing, it is necessary to print a pilot sheet through a series of printing processes, while conveying the pilot sheet. Generally, it is difficult to eliminate the deviation of printing position through one cycle of the printing timing adjustment. Thus, it is necessary to repeatedly measure the deviation amount of printing position by printing onto the pilot sheet, and adjust the printing timing, plural times.

The conventional method designed to actually print a pilot sheet through the printing processes and measure the deviation amount of printing position has a problem that it needs to take a lot of time and effort for preparation prior to a processing operation of the corrugated paperboard sheet box making machine, and a plurality of corrugated paperboard sheets are uneconomically consumed as pilot sheets. Moreover, the measurement of the deviation amount of printing position has to be performed every time a lot order is changed to a next one, which leads to a problem of causing deterioration in production efficiency of corrugated paperboard sheets.

With a view to improving the above problems, a corrugated paperboard sheet box making machine described in JP 2012-11600 A has been proposed. In the corrugated paperboard sheet box making machine described in JP 2012-11600 A, during a preparation stage prior to a processing operation thereof, one corrugated paperboard sheet is fed as a pilot sheet, and printed through a series of processing processes comprising a printing process and a machining process such as slotting or scoring/creasing. At least one camera is provided to image a processed portion, such as a print pattern or a slot, formed on/in the corrugated paperboard sheet. Then, an actual processing position derived from the imaged processed portion is compared with a standard or reference processing position to calculate a deviation amount of processing position. Then, a position adjustment mechanism is operable, based on the calculated deviation amount of processing position, to adjust positions of a printing plate, a slotter knife, etc., in various processing units comprising a printing unit and a machining unit such as a slotter.

SUMMARY OF THE INVENTION

Technical Problem

The corrugated paperboard sheet box making machine described in the JP 2012-11600 A makes it possible to automatically adjust a deviation of installation position in each processing unit, while reducing the number of pilot sheets to one, so that it is more valuable than conventional machines. However, there is a problem that it is necessary to install at least one camera, or install a plurality of cameras correspondingly to respective ones of a plurality of processing units in order to accurately detect a deviation amount of processing position, and another problem that maintenance and inspection works are required to maintain a detection accuracy of each camera. Moreover, nowadays, there is a need to respond to a high-mix low-volume order, so that it is necessary to frequently perform feeding of one pilot sheet and calculation of the deviation amount of processing position, every order changes. Therefore, even the corrugated paperboard sheet box making machine described in the JP 2012-11600 A cannot completely solve the problem of causing deterioration in production efficiency of corrugated paperboard sheets.

Meanwhile, a printing device for a corrugated paperboard sheet box making machine generally comprises a plurality of printing units, and a conveyance device having a suction function for reliably applying a conveyance force to a corrugated paperboard sheet. Through experimental tests on an assumption that a deviation of printing position in each printing unit is primarily due to a deviation of conveyance which is a phenomenon that a timing at which a corrugated paperboard sheet reaches each printing unit gets delayed, the inventors found that there is a certain relationships between the deviation of conveyance and a basis weight of the corrugated paperboard sheet. From a result of the experimental tests, it was found that a deviation amount of conveyance becomes larger as the corrugated paperboard sheet has a larger basis weight, and becomes smaller as the corrugated paperboard sheet has a smaller basis weight.

Based on the finding from the result of the experimental tests, the inventors have devised a technique of adjusting a printing timing of each printing unit according to a basis weight of a corrugated paperboard sheet to be printed through a printing process, without actually measuring the deviation amount of conveyance for the corrugated paperboard sheet.

The present invention has been made to solve the above conventional problems, and an object thereof is to provide a corrugated paperboard sheet printing device capable of accurately forming a print pattern at a predetermined position on a corrugated paperboard sheet without actually measuring a deviation amount of conveyance for the corrugated paperboard sheet, thereby enhancing productivity.

Solution to the Technical Problem (First Aspect of the Present Invention)

In order to achieve the above object, according to a first aspect of the present invention, there is provided a corrugated paperboard sheet printing device which comprises: a conveyance device for conveying, along a conveyance path, a corrugated paperboard sheet fed out from a sheet feeding device, while suckingly holding the corrugated paperboard sheet; a plurality of printing units arranged along the conveyance path and for printing the corrugated paperboard sheet through a series of printing processes; an information generator for generating basis weight information indicative of a basis weight of a corrugated paperboard sheet in each order; a storage device for storing therein a plurality of correction information for correcting a plurality of printing timings at each of which a respective one of the plurality of printing units performs the printing process on the corrugated paperboard sheet, in association with the basis weight information indicative of the basis weight of the corrugated paperboard sheet; and a controller for, based on the correction information stored in association with the basis weight information of the corrugated paperboard sheet, correcting the printing timing in each of the printing units, and causing the printing unit to operate according to the corrected printing timing.

In the first aspect of the present invention, the conveyance device is installed to be located on upstream and downstream sides of each of the printing units so as to suckingly hold a large portion of the corrugated paperboard sheet during a period in which the printing unit operates to form a print pattern (e.g., character or graphic) at a desired position on the corrugated paperboard sheet.

In the first aspect of the present invention, the basis weight of the corrugated paperboard sheet means a weight per unit area of a sum of a liner and a corrugating medium making up the corrugated paperboard sheet.

In the first aspect of the present invention, the storage device may be composed of a single memory for collectively storing therein a plurality of correction information each determined for a respective one of the plurality of printing units, or may be a plurality of unit-by-unit memories each provided for a respective one of the plurality of printing units. As with the storage device, the controller may be composed of a single integrated means, or may be a plurality of unit-by-unit control sub-sections each provided for a respective one of the plurality of printing units.

In the first aspect of the present invention, the storage device may be composed of an external memory configured to allow the correction information to be read therefrom via a network such as the Internet.

In the first aspect of the present invention, the controller may have any configuration, as long as it is configured to perform the settings for the plurality of printing units during a period after termination of a previous order through until a next order is started. For example, the controller may be configured to perform the settings in order from a conveyance direction-wise upstreammost one to downwardmost one of the plurality of printing units, or may be configured to simultaneously perform the settings for all of the printing units.

Generally, a reference printing timing in each of the printing unit is set with respect to a feed-out start timing at which a corrugated paperboard sheet is fed out from the sheet feeding device. In the first aspect of the present invention, the correction information is used for delaying an actual printing from the reference printing timing.

Preferably, in the first aspect of the present invention, the storage device is configured to store therein the correction information in association with the basis weight information of the corrugated paperboard sheet, as information for performing the correction in such a manner that that an amount of delay of the printing timing in each of the printing units becomes larger as the corrugated paperboard sheet has a larger basis weight.

In this specific embodiment, the controller is operable, according to the plurality of correction information stored in the storage device, to control the plurality of printing units in such a manner that the delay amount of the printing timing in each of the printing units becomes larger as the corrugated paperboard sheet has a larger basis weight. Generally, a rigidity of a corrugated paperboard sheet becomes larger as the corrugated paperboard sheet has a larger basis weight. In a situation where a corrugated paperboard sheet is suckingly held by the conveyance device, as the corrugated paperboard sheet has a larger basis weight, it becomes less likely to be deformed, so that a frictional force with respect to the conveyance device becomes smaller, and becomes more likely to slip with respect thereto. For such an easily-slipping corrugated paperboard sheet, the delay amount of the printing timing is set to a larger value, so that each of the printing units can accurately form a print pattern at a predetermined position on the corrugated paperboard sheet.

In this specific embodiment, the delay amount of the printing timing indicated by the correction information is not necessarily set to become larger in a continuous and gradual manner as the corrugated paperboard sheet has a larger basis weight, but may be set to become larger in a step-wise manner as the corrugated paperboard sheet has a larger basis weight.

Preferably, in the first aspect of the present invention, the information generator is operable to further generate sheet length information indicative of a conveyance direction-wise sheet length of a corrugated paperboard sheet in each order, wherein the storage device is configured to store the correction information in association of the basis weight information indicative of the basis weight of the corrugated paperboard sheet, and the sheet length information indicative of the sheet length of the corrugated paperboard sheet.

In this specific embodiment, the controller is operable, according to the plurality of correction information stored in the storage device, to control the plurality of printing units in such a manner as to correct respective printing timings of the plurality of printing units, thereby causing each of the plurality of printing units to operate in conformity to the basis weight of the corrugated paperboard sheet and the conveyance direction-wise sheet length of the corrugated paperboard sheet. Generally, a corrugated paperboard sheet is suckingly held in a wider range by the conveyance device having a suction function, as the corrugated paperboard sheet has a larger conveyance direction-wise sheet length, so that a frictional force with respect to the conveyance device becomes larger, and the corrugated paperboard sheet becomes less likely to slip with respect thereto. In this way, the printing timings are corrected according to the sheet length of the corrugated paperboard sheet having an influence on conveyance accuracy, so that each of the printing units can further accurately form a print pattern at a predetermined position on the corrugated paperboard sheet.

In this specific embodiment, the correction information may be stored in association with a sheet width of the corrugated paperboard sheet in a direction orthogonal to the conveyance direction, in addition to the basis weight of the corrugated paperboard sheet and the conveyance direction-wise sheet length of the corrugated paperboard sheet. Generally, a sheet width of a corrugated paperboard sheet becomes larger along with an increase in conveyance direction-wise sheet length of the corrugated paperboard sheet. Thus, the association with the sheet width may be considered as association with a surface area of the corrugated paperboard sheet.

Preferably, in the first aspect of the present invention, the storage device is configured to store therein the correction information in association with the basis weight information and the sheet length information of the corrugated paperboard sheet, as information for performing the correction in such a manner that the delay amount of the printing timing in each of the printing units becomes larger as the corrugated paperboard sheet has a larger basis weight, and become smaller as the corrugated paperboard sheet has a larger conveyance direction-wise sheet length.

In this specific embodiment, the controller is operable, according to the plurality of correction information stored in the storage device, to control the plurality of printing units in such a manner that the delay amount of the printing timing in each of the printing units becomes larger as the corrugated paperboard sheet has a larger basis weight, and become smaller as the corrugated paperboard sheet has a larger conveyance direction-wise sheet length. Generally, a frictional force with respect to the conveyance device having a suction function becomes larger as the corrugated paperboard sheet has a larger conveyance direction-wise sheet length, so that the corrugated paperboard sheet becomes less likely to slip with respect to the conveyance device. In this way, the delay amount of the printing timing is set to a smaller value according to the sheet length of the corrugated paperboard sheet having an influence on conveyance accuracy, so that each of the printing units can further accurately form a print pattern at a predetermined position on the corrugated paperboard sheet.

In this specific embodiment, the delay amount of the printing timing indicated by the correction information is not necessarily set to become smaller in a continuous and gradual manner as the corrugated paperboard sheet has a larger conveyance direction-wise sheet length, but may be set to become smaller in a step-wise manner as the corrugated paperboard sheet has a larger conveyance direction-wise sheet length.

Preferably, in the first aspect of the present invention, the storage device is configured to store therein the correction information in association with the basis weight information of the corrugated paperboard sheet, as information for performing the correction in such a manner that the delay amount of the printing timing in each of the printing units is cumulatively increased as the printing unit is located on a farther downstream side of the arrangement along the conveyance path.

In this specific embodiment, the storage device is configured to store therein correction information set for performing the correction in such a manner that the delay amount of the printing timing in each of the printing units is cumulatively increased as the printing unit is located on a farther downstream side of the arrangement along the conveyance path. Generally, among corrugated paperboard sheets which are identical in terms of type and size, it is considered that they have approximately the same slipping amount per unit length of the conveyance path, with respect to the conveyance device. Thus, the slipping amount is cumulatively increased toward the printing unit located on a farther downstream side. In this way, the delay amount of the printing timing is set depending on an installation position of each of the printing units having an influence on a cumulative slipping amount, so that each of the printing units can further accurately form a print pattern at a predetermined position on the corrugated paperboard sheet.

In this specific embodiment, the delay amount of the printing timing indicated by the correction information is not necessarily set to continually become larger as the printing unit is located on a farther downstream side of the arrangement along the conveyance path, but may be set to the same value for adjacent two of the printing units.

Preferably, in the first aspect of the present invention, each of the plurality of printing units comprises: a printing cylinder rotatable to perform the printing process on the corrugated paperboard sheet; and a timing adjuster for adjusting a printing timing of the printing cylinder, with respect to a feed-out start timing at which a corrugated paperboard sheet is fed out from the sheet feeding device, wherein the controller is operable to control the timing adjuster, thereby correcting the printing timing in each of the printing units, and causing the printing unit to operate according to the correct printing timing.

In this specific embodiment, each of the printing units has the timing adjuster for adjusting the printing timing of the printing cylinder with respect to the feed-out start timing of a corrugated paperboard sheet from the sheet feeding device, wherein the controller is operable, according to the correction information, to control the timing adjuster so as to set a stop position where each of the printing units is set in a stand-by state in advance of the printing process. Thus, the printing timing in the printing cylinder can be accurately adjusted with respect to the feed-out start timing of a corrugated paperboard sheet from the sheet feeding device, so that the printing cylinder can accurately form a print pattern at a predetermined position on the corrugated paperboard sheet.

In this specific embodiment, the timing adjuster may have any configuration, as long as it is configured to adjust the printing timing of the printing cylinder in each of the printing units, with respect to the feed-out start timing of a corrugated paperboard sheet from the sheet feeding device. For example, the timing adjuster may comprise a differential mechanism, called "harmonic drive" (registered trademark), and a differential motor, wherein it is configured to set a stop position of the printing cylinder according to rotation control of the differential motor. Alternatively, it may be configured to control a rotational speed of the printing cylinder in each of the printing units according to rotation control of a servomotor for rotationally driving the printing cylinder, individually.

In this specific embodiment, the controller may be configured to, according to the correction information read by a read section, control a rotational displacement amount from a stop position of the printing cylinder in each of the printing units regarding a previous order, to a stop position of the printing cylinder in the printing unit regarding a next order, or may be configured to, according to the correction information read by a read section, control a rotational displacement amount from a preliminarily setup reference position of the printing cylinder in each of the printing units, to a stop position of the printing cylinder in the printing unit in regard to a next order.

As a modification of the first aspect of the present invention, there is provided a corrugated paperboard sheet printing device which comprises: a conveyance device for conveying, along a conveyance path, a corrugated paperboard sheet fed out from a sheet feeding device, while suckingly holding the corrugated paperboard sheet; a plurality of printing units arranged along the conveyance path and for printing the corrugated paperboard sheet through a series of printing processes; a setting device to allow an operator to set basis weight information indicative of a basis weight of a corrugated paperboard sheet in each order, and sheet length information indicative of a conveyance direction-wise sheet length of the corrugated paperboard sheet each set by the operator; and a controller for, based on the basis weight information and the sheet length information each set by the operator, correcting the printing timing in each of the printing units, and causing the printing unit to operate according to the corrected printing timing.

(Second Aspect of the Present Invention)

In order to achieve the above object, according to a second aspect of the present invention, there is provided a corrugated paperboard sheet printing device which comprises: a conveyance device for conveying, along a conveyance path, a corrugated paperboard sheet fed out from a sheet feeding device; a plurality of printing units arranged along the conveyance path and for printing the corrugated paperboard sheet through a series of printing processes; a plurality of machining units arranged along the conveyance path to machine, through a series of machining processes, the corrugated paperboard sheet after being printed through the series of printing processes by the plurality of printing units; an information generator for generating basis weight information indicative of a basis weight of a corrugated paperboard sheet in each order; a storage device for storing therein a plurality of correction information for correcting a plurality of printing timings at each of which a respective one of the plurality of printing units performs the printing process on the corrugated paperboard sheet, and a plurality of machining timings at each of which a respective one of the plurality of machining units performs the machining process on the corrugated paperboard sheet, in association with the basis weight information indicative of the basis weight of the corrugated paperboard sheet; and a controller for, based on the correction information stored in association with the basis weight information of the corrugated paperboard sheet, correcting the printing timing in each of the printing units and the machining timing in each of the machining units, and causing the printing unit and the machining unit to operate according to the corrected printing timing and the corrected machining timing, respectively, wherein the conveyance device is operable to convey the corrugated paperboard sheet while suckingly holding the corrugated paperboard sheet, in a region where the plurality of printing units are arranged.

In the second aspect of the present invention, the machining units have a configuration which needs to set the machining timing at which the corrugated paperboard sheet being conveyed along the conveyance path is machined through the machining process. Alternatively, a machining line may comprise a machining unit having no need to set the machining timing. The machining unit having no need to set the machining timing may include a machining unit having no need to adjust a machining position in the conveyance direction, for example, a creaser for creasing a corrugated paperboard sheet through a creasing process.

In the second aspect of the present invention, with regard to a region where the plurality of machining units are arranged, the conveyance device may be configured to convey the corrugated paperboard sheet while suckingly holding the corrugated paperboard sheet, or may be configured to convey the corrugated paperboard sheet without suckingly holding the corrugated paperboard sheet.

(Third Aspect of the Present Invention)

In order to achieve the above object, according to a third aspect of the present invention, there is provided a management device for a corrugated paperboard sheet box making machine comprising: a conveyance device for conveying, along a conveyance path, a corrugated paperboard sheet fed out from a sheet feeding device; a plurality of printing units arranged along the conveyance path to print the corrugated paperboard sheet through a series of printing processes; and a plurality of machining units arranged along the conveyance path to machine, through a series of machining processes, the corrugated paperboard sheet after being printed through the series of printing processes by the plurality of printing units, wherein the conveyance device is operable to convey the corrugated paperboard sheet while suckingly holding the corrugated paperboard sheet, in a region where the plurality of printing units are arranged. The management device comprises: an information generator for generating basis weight information indicative of a basis weight of a corrugated paperboard sheet in each order; a storage device for storing therein a plurality of correction information for correcting a plurality of printing timings at each of which a respective one of the plurality of printing units performs the printing process on the corrugated paperboard sheet, and a plurality of machining timings at each of which a respective one of the plurality of machining units performs the machining process on the corrugated paperboard sheet, in association with the basis weight information indicative of the basis weight of the corrugated paperboard sheet; and a controller for, based on the correction information stored in association with the basis weight information of the corrugated paperboard sheet, correcting the printing timing in each of the printing units and the machining timing in each of the machining units, and causing the printing unit and the machining unit to operate according to the corrected printing timing and the corrected machining timing, respectively.

In the second and third aspects of the present invention, each of the elements may be embodied in various forms, as in the first aspect of the present invention.

Effect of the Invention (Advantageous Effects in First to Third Aspects of the Present Invention)

In the first to third aspects of the present invention, the printing timing in each of the printing units is corrected according to the basis weight information indicative of the basis weight of the corrugated paperboard sheet being conveyed while being suckingly held by the conveyance device/device, so that it becomes possible to eliminate a need for a time-consuming preparation work for actually measuring the deviation amount of conveyance, using a corrugated paperboard sheet to be printed through the printing processes, and allow each of the printing units to accurately form a print pattern at a predetermined position on the corrugated paperboard sheet. In the second and third aspects of the present invention, the machining timing in each of the machining units arranged downstream of the plurality of printing units is also corrected according to the basis weight of the corrugated paperboard sheet, so that a corrugated paperboard sheet to be machined can also become free of the need for a time-consuming preparation work for actually measuring the deviation amount of conveyance, and each of the machining units can accurately form a machined portion at a predetermined position on the corrugated paperboard sheet.

BRIEF DESCRIPTION OF THE DRAWINGS

FIG. 5 is an explanatory chart presenting a content stored in a correction memory, in the corrugated paperboard sheet box making machine according to the embodiment.

DESCRIPTION OF EMBODIMENTS

[Embodiment]

With reference to the drawings, the present invention will now be described based on one embodiment thereof, wherein which the present invention is applied to a corrugated paperboard sheet box making machine for printing a corrugated paperboard sheet fed out from a sheet feeding device through various processing processes comprising a printing process and a machining process such as scoring/creasing and slotting. As used there, an up-down direction (upward and downward directions), a right-left direction (rightward and leftward directions) and a front-rear direction (frontward and rearward directions) are defined by directions indicated by arrowed lines in each figure.

<<General Configuration>>

Figure 1:
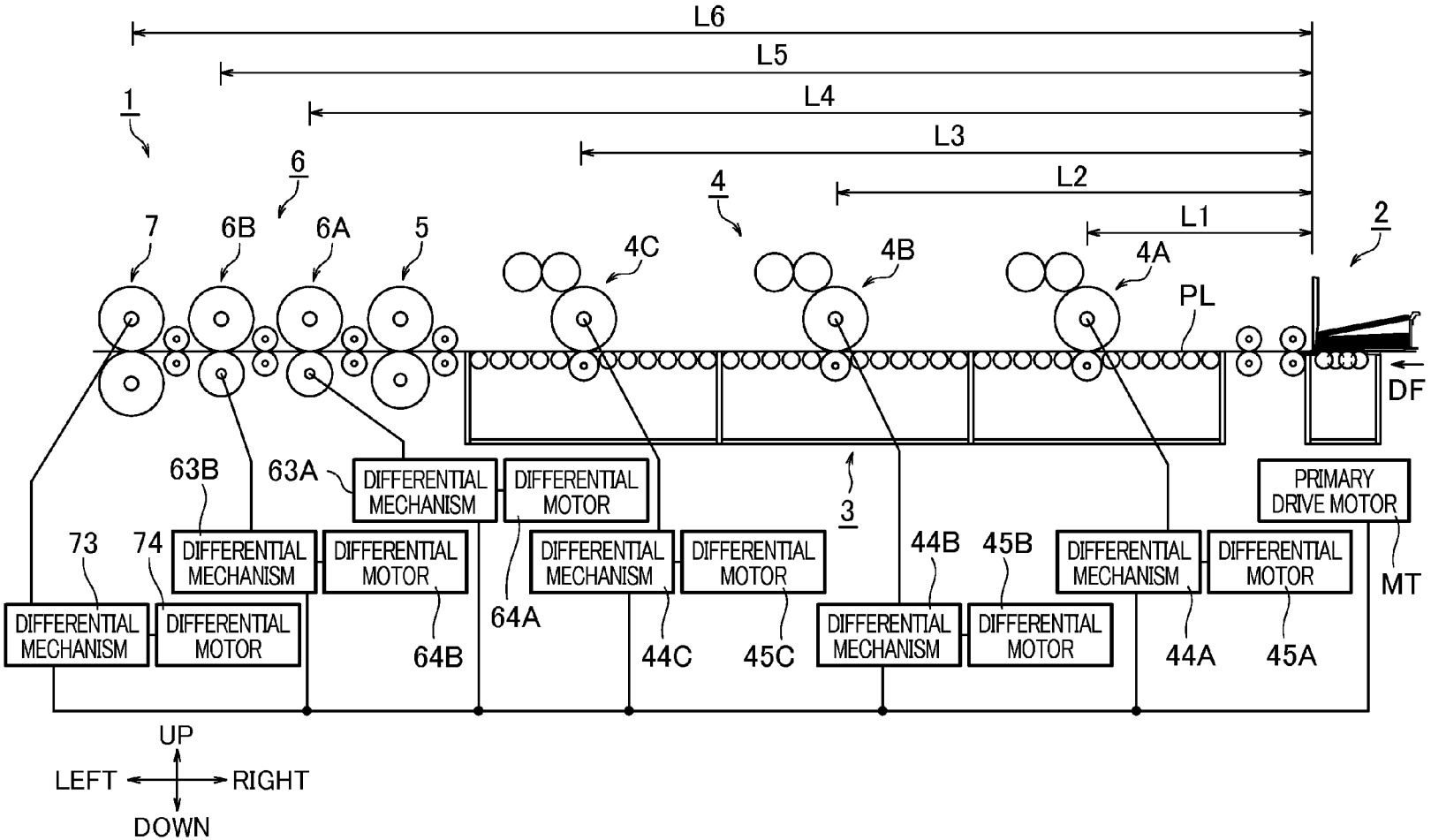
FIG. 1 is a front view illustrating a general configuration of a corrugated paperboard sheet box making machine according to one embodiment of the present invention.

FIG. 1 illustrates a general configuration of a corrugated paperboard sheet box making machine 1 according to this embodiment. The corrugated paperboard sheet box making machine 1 comprises: a sheet feeding device 2 for feeding corrugated paperboard sheets SH one-by-one toward a conveyance path PL; a conveyance device 3 for conveying the corrugated paperboard sheet SH fed from the sheet feeding device 2, along the conveyance path PL; and a plurality of processing units arranged along the conveyance path PL to sequentially process, through various processing processes, the corrugated paperboard sheet SH being conveyed. In this embodiment, as the plurality of processing units, the corrugated paperboard sheet box making machine 1 is provided with three printing units 4A to 4C for printing a corrugated paperboard sheet SH through three types of printing processes, and a plurality of machining units including: a creaser device 5 for forming a conveyance direction-wise crease line in the corrugated paperboard sheet SH; two slotter units 6A, 6B for slotting front and rear ends of the corrugated paperboard sheet SH through a slotting process; and a die-cutter device 7 for performing a punching process on the corrugated paperboard sheet SH. In this embodiment, the three printing units 4A to 4C are comprised in a printing device 4, and the two slotter units 6A, 6B are comprised in a slotter device 6.

<Sheet Feeding Device>

Figure 2:
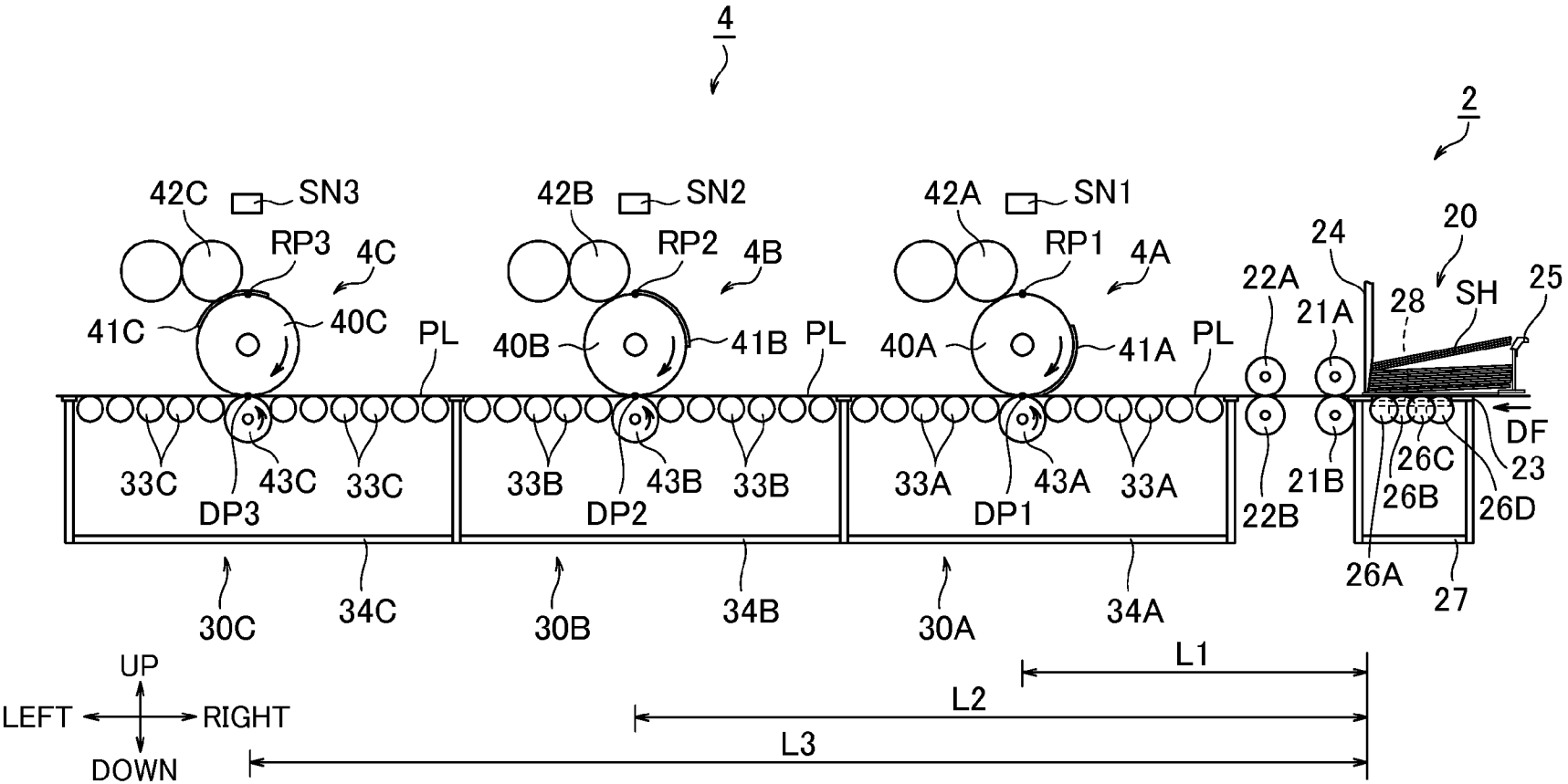
FIG. 2 is an enlarged front view illustrating a sheet feeding device and a printing device in the corrugated paperboard sheet box making machine according to the embodiment.

FIG. 2 is an enlarged view illustrating the sheet feeding device 2 and the printing device 4 in the corrugated paperboard sheet box making machine 1. In FIG. 2, the sheet feeding device 2 comprises a sheet feeding unit 20, a first set of feed rolls 21A, 21B, and a second set of feed rolls 22A, 22B. The sheet feeding device 2 is operable to feed corrugated paperboard sheets SH one-by-one from the sheet feeding unit 20, and sequentially convey the corrugated paperboard sheets SH while clamping them by the first set of feed rolls 21A, 21B and the second set of feed rolls 22A, 22B, thereby feeding out them toward the printing device 4. The first set of feed rolls 21A, 21B are disposed on a downstream side of the sheet feeding unit 20, as viewed in a sheet feed direction DF along which each of the corrugated paperboard sheets SH is fed out. The second set of feed rolls 22A, 22B are disposed on a downstream side of the first set of feed rolls 21A, 21B, as viewed in the sheet feed direction DF. The feed rolls in the first and second sets of feed rolls are rolls having the same diameter, and each of them is coupled to and driven by a primary drive motor MT.

(Sheet Feeding Unit)

The sheet feeding unit 20 comprises a sheet feed table 23, and a front gate 24 and a back guide 25 each disposed just above the sheet feed table 23. The front gate 24 is disposed at a fixed position in the sheet feed direction DF. The front gate 24 is dispose to be in contact with front edges of a large number of stacked corrugated paperboard sheets, i.e., in contact with left edges of the corrugated paperboard sheets in FIG. 1, thereby truing up the front edges of the corrugated paperboard sheets. The back guide 25 is disposed in such a manner as to be movable in a right-left direction with respect to the front gate 24, in conformity to a length of each of the corrugated paperboard sheets in the sheet feed direction DF. The back guide 25 is dispose to be in contact with rear edges of the corrugated paperboard sheets, i.e., in contact with right edges of the corrugated paperboard sheets in FIG. 1, thereby truing up the rear edges of the corrugated paperboard sheets.

The sheet feeding unit 20 further comprises four rows of sheet feed rolls 26A to 26D, a suction mechanism 27 and a grate 28 each disposed just below the sheet feed table 23. The suction mechanism 27 is operable to suck the stacked corrugated paperboard sheets in a downward direction. The suction mechanism 27 has a conventional configuration, and comprises a suction chamber, a duct and a blower motor. Upon rotational driving of the blower motor, a large negative pressure is produced in the suction chamber, so that the stacked corrugated paperboard sheets are sucked toward the sheet feed rolls 26A to 26D by a large suction force.

The grate 28 is configured to be lifted and lowered with respect to the sheet feed rolls 26A to 26D according to rotation of a non-illustrated cam. The grate 28 is operable, when it is lifted to a position above the sheet feed rolls 26A to 26D, to cause the corrugated paperboard sheets SH to be moved away from the sheet feed rolls 26A to 26D. Further, the grate 28 is operable, when it is lowered to a position below the sheet feed rolls 26A to 26D, to cause a lowermost one of the corrugated paperboard sheets SH to come into contact with the sheet feed rolls 26A to 26D. The cam for lifting and lowering the grate 28 is fixed on a drive shaft which is coupled to the primary drive motor MT via a speed reducing mechanism. The cam is configured to be rotated by 360 degrees during a period in which the sheet feeding unit 20 feeds one corrugated paperboard sheet SH. A mechanism for lifting and lowering the grate 28 is described, for example, in U.S. Pat. No. 5,184,811.

The sheet feed rolls 26A to 26D are coupled, via a power transmission mechanism, to the drive shaft on which the cam is fixed. The power transmission mechanism comprises a Geneva gear and a planetary gear. A configuration of the power transmission mechanism is described, for example, in U.S. Pat. No. 5,184,811. Through the power transmission mechanism, a circumferential velocity of each of the sheet feed rolls 26A to 26D is increased from a rotationally stopped state (zero value) up to a given value equal to that of each of the first set of feed rolls 21A, 21B during an operation of feeding one corrugated paperboard sheet, and then the given circumferential velocity is maintained, whereafter the circumferential velocity is reduced from the given value to the rotationally stopped state. At a start point of the sheet feed operation, i.e., a time point when the grate 28 is lowered to a position below an upper surface of each of the sheet feed rolls 26A to 26D, the circumferential velocity of each of the sheet feed rolls 26A to 26D is approximately in the rotationally stopped state.

<Conveyance Device>

Figure 3:
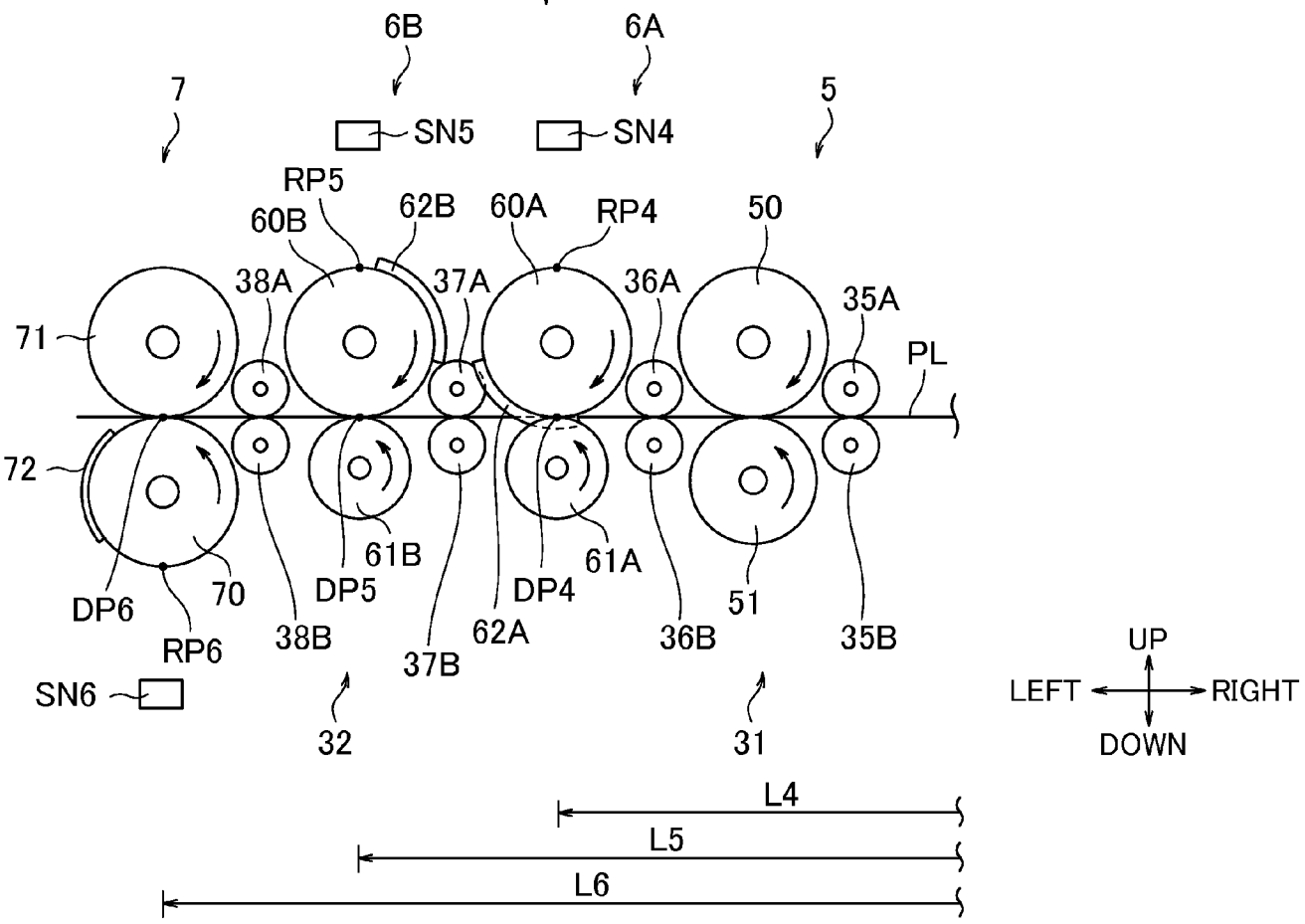
FIG. 3 is an enlarged front view illustrating a creaser device, a slotter device and a die-cutter device in the corrugated paperboard sheet box making machine according to the embodiment.

FIG. 3 is an enlarged view illustrating the creaser device, the slotter device and the die-cutter device in the corrugated paperboard sheet box making machine. In FIGS. 2 and 3, the conveyance device 3 comprises a plurality of printing-related conveyance sections 30A to 30C, a creaser-related conveyance section 31 and a slotter-related conveyance section 32. These conveyance sections are arranged along the conveyance path PL to convey the corrugated paperboard sheet SH in the conveyance direction directing from a right side toward a left side. The printing-related conveyance sections 30A to 30C have a common fundamental configuration which has a suction function of suckingly holding the corrugated paperboard sheet SH. In the case where a set of nip rollers for conveying a corrugated paperboard sheet while nipping it therebetween are used as printing-related conveyance means, when printing ink on the corrugated paperboard sheet is in an un-dried state, the printing ink adheres to the nip rollers, which is likely to stain a corrugated paperboard sheet subsequently conveyed. Therefore, instead of the nip rollers, a conveyance section having a suction function, such as each of the printing-related conveyance sections 30A to 30C, is used as the printing-related conveyance means. The printing-related conveyance section 30A comprises a large number of conveyance rollers 33A arranged along the conveyance path PL, and a suction mechanism 34A provided just below the conveyance rollers 33A. The suction mechanism 34A comprises a suction chamber, a duct and a blower motor. The large number of conveyance rollers 33A are coupled to the primary drive motor MT via a conventional power transmission mechanism, in such a manner that it is rotated at the same circumferential velocity as that of each of the first set of feed rolls 21A, 21B according to rotation of the primary drive motor MT. As with the printing-related conveyance section 30A, each of the printing-related conveyance sections 30B, 30C comprises a large number of conveyance rollers (33B, 33C) arranged along the conveyance path PL, and a suction mechanism (34B, 34C) provided just below the conveyance rollers.

The creaser-related conveyance section 31 and the slotter-related conveyance section 32 have a common fundamental configuration which comprises a pair of feed rolls for conveying the corrugated paperboard sheet while clamping it. The creaser-related conveyance section 31 comprises a set of feed rolls 35A, 35B disposed upstream of the creaser device 5, and a set of feed rolls 36A, 36B disposed downstream of the creaser device 5. The slotter-related conveyance section 32 comprises a set of feed rolls 37A, 37B disposed downstream of the slotter unit 6A, and a set of feed rolls 38A, 38B disposed downstream of the slotter unit 6B. Each of the feed rolls of the creaser-related conveyance section 31 and the slotter-related conveyance section 32 is a roll having the same diameter as that of each of the first set of feed rolls 21A, 21B, and coupled to the primary drive motor MT.

<Printing Device>

In this embodiment, the printing device 4 comprises the three printing units 4A to 4C for printing a corrugated paperboard sheet SH, being conveyed by the printing-related conveyance sections 30A to 30C, through three types of printing processes, e.g., a three-color printing process. The printing units 4A to 4C have the same fundamental configuration. The printing unit 4A primarily comprises a printing cylinder 40A, a printing plate member 41A having a print pattern to be formed on the corrugated paperboard sheet SH, an ink applicator 42A, and a press roll 43A. The printing cylinder 40A is rotatably supported by a frame of the printing unit 4A, and coupled to the primary drive motor MT via a conventional power transmission mechanism, in such a manner that it is rotated in a direction indicated by the arrowed line in FIG. 2, according to rotation of the primary drive motor MT.

The printing plate member 41A is wrappingly attached to an outer peripheral surface of the printing cylinder 40A. The printing plate member 41A is formed by laminating a printing plate on a base film made of a synthetic resin. The printing plate member 41A has one end which is fixed to the printing cylinder 40A in such a manner as to be inserted into a fixing groove formed in the outer peripheral surface of the printing cylinder 40A, and the other end attached to the printing cylinder 40A in such a manner as to be taken up by a take-up mechanism provided on the outer peripheral surface of the printing cylinder 40A. During order change, the printing plate member 41A can be replaced with another printing plate member having a print pattern conforming to a next order.

The press roll 43A is disposed at a position opposed to the printing cylinder 40A across the conveyance path PL, and coupled to the primary drive motor MT via a conventional power transmission mechanism, in such a manner that it is rotated in a direction indicated by the arrowed line in FIG. 2, according to rotation of the primary drive motor MT. The large number of conveyance rollers 33A of the printing-related conveyance section 30A are arranged on upstream and downstream sides with respect to the opposed position between the printing cylinder 40A and the press roll 43A. The press roll 43A is configured to, in cooperation with the printing plate of the printing plate member 41A wrappingly attached to the printing cylinder 40A, clamp the corrugated paperboard sheet SH being conveyed by the printing-related conveyance section 30A, thereby attaining a desired printing process. As with the printing unit 4A, each of the printing units 4B, 4C primarily comprises a printing cylinder (40B, 40C), a printing plate member (41B, 41C), an ink applicator (42B, 42C), and a press roll (43B, 43C).

(Differential Mechanism)

Each of the printing units 4A to 4C further comprises a differential mechanism (44A to 44C) and a differential motor (45A to 45C) composed of a servomotor. Each of the differential mechanisms is configured to adjust a rotation phase of a respective one of the printing cylinders in such a manner that a position of a print pattern to be formed on the corrugated paperboard sheet SH by the printing cylinder conforms to a predetermined position. In this embodiment, each of the differential mechanisms is composed of a harmonic drive (registered trademark). Each of the differential motors can be rotationally driven to allow a rotation phase of an associated one of the printing cylinders to be adjusted with respect to a corresponding one of the press rolls driven by drive power transmitted from the primary drive motor MT. A power transmission mechanism using a harmonic drive (registered trademark) to transmit drive power to a rotary main shaft of a processing unit for processing a corrugated paperboard sheet is described in U.S. Pat. No. 3,882,745 (FIG. 7).

In a state in which, according to rotational drive of each of the differential motors, a rotation phase of an associated one of the printing cylinders is adjusted with respect to a corresponding one of the press rolls, the printing cylinder and the press roll are rotated in respective directions indicated by the arrowed lines in FIG. 2 at the same circumferential velocity equal to that of each of the first set of feed rolls 21A, 21B.

<Creaser Device>

As illustrated in FIG. 3, the creaser device 5 comprises an upper creasing roll 50 and a lower creasing roll 51 which are disposed across the conveyance path PL. The set of rolls 50, 51 are coupled to the primary drive motor MT via a power transmission mechanism, and rotated in respective directions indicated by the arrowed lines in FIG. 3 at the same circumferential velocity as that of each of the first set of feed rolls 21A, 21B according to rotation of the primary drive motor MT. The set of rolls 50, 51 are operable to form a conveyance direction-wise crease line at a desired position in the corrugated paperboard sheet SH being conveyed by the creaser-related conveyance section 31.

<Slotter Device>

In this embodiment, the slotter device 6 comprises the slotter unit 6A and the slotter unit 6A which are disposed in upstream and downstream relation to each other along the conveyance path PL, in order to slot front and rear ends of the corrugated paperboard sheet SH, being conveyed by the slotter-related conveyance section 32, through a slotting process. In FIG. 3, the slotter unit 6A comprises an upper slotter 60A and a lower slotter 61A which are disposed across the conveyance path PL. A slotter blade 62A is attached to an outer peripheral surface of the upper slotter 60A in a positionally adjustable manner. Correspondingly, a groove capable of fittingly receiving therein the slotter blade 62A is formed in an outer peripheral surface of the lower slotter 61A. The lower slotter 61A is disposed at a position opposed to the upper slotter 60A across the conveyance path PL, and coupled to the primary drive motor MT via a conventional power transmission mechanism, in such a manner that it is rotated in a direction indicated by the arrowed line in FIG. 3, according to rotation of the primary drive motor MT. Further, the slotter unit 6B comprises an upper slotter 60B and a lower slotter 61B which are disposed across the conveyance path PL. A slotter blade 62B is attached to an outer peripheral surface of the upper slotter 60B in a positionally adjustable manner. Correspondingly, a groove capable of fittingly receiving therein the slotter blade 62B is formed in an outer peripheral surface of the lower slotter 61B. The lower slotter 61B is disposed at a position opposed to the upper slotter 60B across the conveyance path PL, and coupled to the primary drive motor MT via a power transmission mechanism, in such a manner that it is rotated in a direction indicated by the arrowed line in FIG. 3, according to rotation of the primary drive motor MT.

(Differential Mechanism)

Each of the slotter units 6A, 6B further comprises a differential mechanism (63A, 63B) and a differential motor (64A, 64B) composed of a servomotor. Each of the differential mechanisms is configured to adjust a rotation phase of a respective one of the upper slotters in such a manner that a position of a slot to be formed in the corrugated paperboard sheet SH by a corresponding one of the slotter blades conforms to a predetermined position. In this embodiment, each of the differential mechanisms 63A, 63B is composed of a harmonic drive (registered trademark), as with each of the differential mechanisms 44A to 44C. Each of the differential motors can be rotationally driven to allow a rotation phase of an associated one of the upper slotters to be adjusted with respect to a corresponding one of the lower slotters driven by drive power transmitted from the primary drive motor MT.

In a state in which, according to rotational drive of each of the differential motors, a rotation phase of an associated one of the upper slotters is adjusted with respect to a corresponding one of the lower slotters, the upper slotter and the lower slotter are rotated in respective directions indicated by the arrowed liners in FIG. 3 at the same circumferential velocity equal to that of each of the first set of feed rolls 21A, 21B.

<Die-Cutter Device>

The die-cutter device 7 comprises a die cylinder 70 and an anvil cylinder 71 which are disposed across the conveyance path PL. A punching die 72 for punching the corrugated paperboard sheet SH through a punching process is attached to a plate-shaped member such as a veneer board, and then the plate-shaped member is wrappingly attached to an outer peripheral surface of the die cylinder 70. The anvil cylinder 71 is disposed at a position opposed to the die cylinder 70 across the conveyance path PL, and coupled to the primary drive motor MT via a conventional power transmission mechanism, in such a manner that it is rotated in a direction indicated by the arrowed line in FIG. 3, according to rotation of the primary drive motor MT. The punching die 72 is configured to form a punched hole at a desired position in the corrugated paperboard sheet SH being continuously conveyed. During order change, the punching die 72 can be replaced with another punching die having a punching pattern conforming to a next order.

(Differential Mechanism)

The die-cutter device 7 further comprises a differential mechanism 73 and a differential motor 74 composed of a servomotor. The differential mechanism 73 is configured to adjust a rotation phase of the die cylinder 70 in such a manner that a position of a punched hole to be formed in the corrugated paperboard sheet SH by the punching die 72 conforms to a predetermined position. In this embodiment, the differential mechanism 73 is composed of a harmonic drive (registered trademark), as with each of the differential mechanisms 44A to 44C. The differential motor 74 can be rotationally driven to allow a rotation phase of the die cylinder 70 to be adjusted with respect to the anvil cylinder 71 driven by drive power transmitted from the primary drive motor MT.

In a state in which, according to rotational drive of the differential motor 74, a rotation phase of the die cylinder 70 is adjusted with respect to the anvil cylinder 71, the die cylinder 70 and the anvil cylinder 71 are rotated in respective directions indicated by the arrowed lines in FIG. 3 at the same circumferential velocity equal to that of each of the first set of feed rolls 21A, 21B.

(Installation Positions of Printing Units and others)

The front gate 24 is installed at a fixed position in the sheet feed direction DF. Thus, on an assumption that the installation position of the front gate 24 is defined as a sheet feed start position of the corrugated paperboard sheet SH, installation positions of the printing units 4A to 4C and other processing units are set. A rotary shaft of each of the printing cylinder 41A and the press roll 43A in the printing unit 4A is located at a position spaced apart from the sheet feed start position by a distance L1 in the conveyance direction of the corrugated paperboard sheet SH. A rotary shaft of each of the printing cylinder 41 B and the press roll 43B in the printing unit 4B is located at a position spaced apart from the sheet feed start position by a distance L2 in the conveyance direction of the corrugated paperboard sheet SH. A rotary shaft of each of the printing cylinder 41C and the press roll 43C in the printing unit 4C is located at a position spaced apart from the sheet feed start position by a distance L3 in the conveyance direction of the corrugated paperboard sheet SH.

A rotary shaft of each of the upper slotter 60A and the lower slotter 61A in the slotter unit 6A is located at a position spaced apart from the sheet feed start position by a distance L4 in the conveyance direction of the corrugated paperboard sheet SH. A rotary shaft of each of the upper slotter 60B and the lower slotter 61 B in the slotter unit 6B is located at a position spaced apart from the sheet feed start position by a distance L5 in the conveyance direction of the corrugated paperboard sheet SH. A rotary shaft of each of the die cylinder 70 and the anvil cylinder 71 in the die-cutter device 7 is located at a position spaced apart from the sheet feed start position by a distance L6 in the conveyance direction of the corrugated paperboard sheet SH.

<<Electrical Configuration>>

Figure 4:
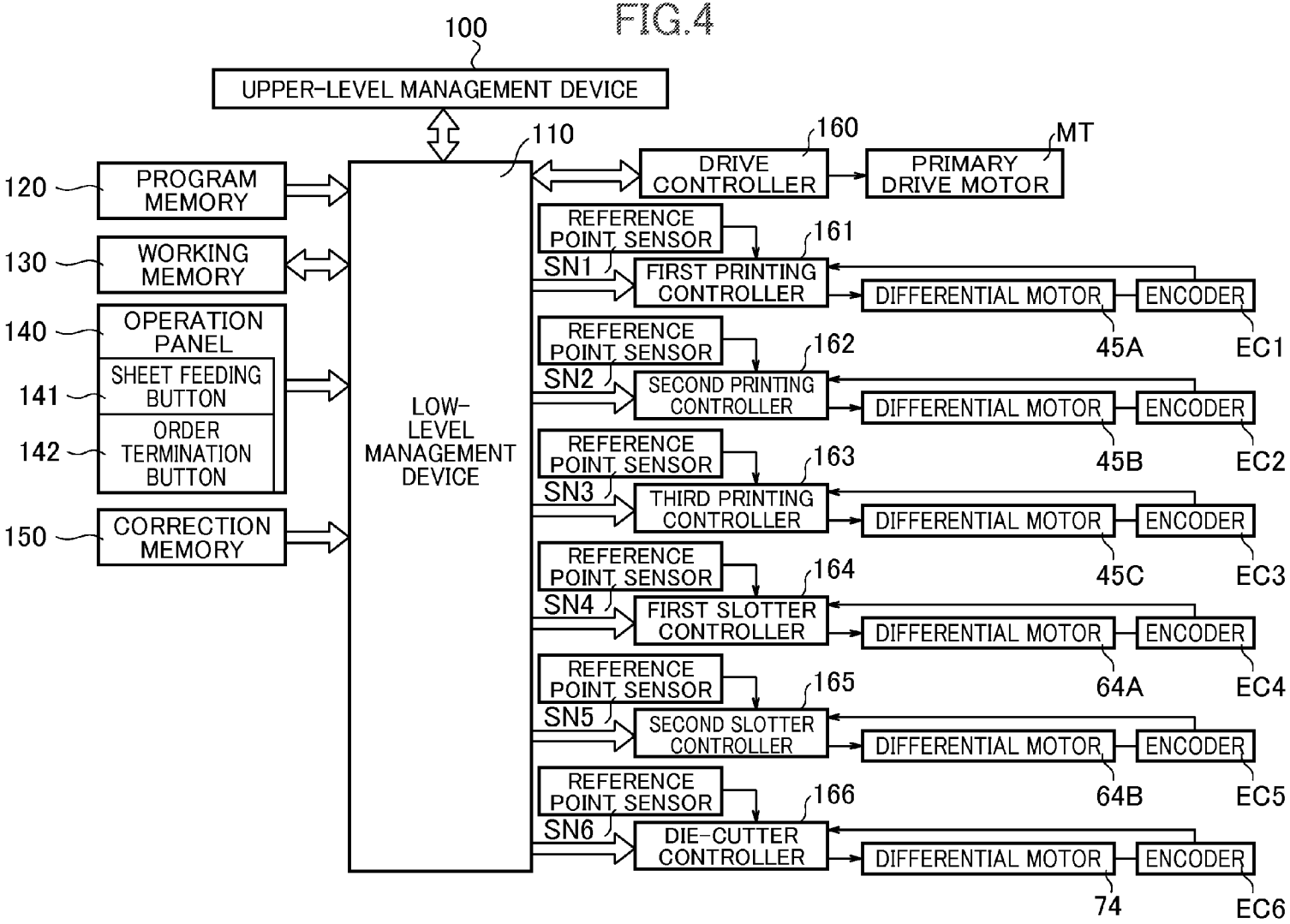
FIG. 4 is a block diagram illustrating an electrical configuration of the corrugated paperboard sheet box making machine according to the embodiment.

With reference to FIG. 4, an electrical configuration of the corrugated paperboard sheet box making machine 1 according to this embodiment will be described below. FIG. 4 is a block diagram illustrating an electrical configuration of the corrugated paperboard sheet box making machine 1. In FIG. 4, an upper-level management device 100 and a low-level management device 110 are provided to generally manage processing processes of a corrugated paperboard sheet in the corrugated paperboard sheet box making machine 1. In this embodiment, the upper-level management device 100 is configured to store therein a management plan for executing a large number of orders in a predetermined sequence. The upper-level management device 100 is operable, on an order-by-order basis, to send, to the low-level management device 110, control instruction information such as a motor speed of the primary drive motor MT, a size of a corrugated paperboard sheet, a total basis weight of the corrugated paperboard sheet, and the number of corrugated paperboard sheets to be processed.

The low-level management device 110 is configured to control respective operations of various drive sections such as the primary drive motor MT and the blower motors of the printing-related conveyance sections 30A to 30C, and perform management control, e.g., control operation of counting the number of processed corrugated paperboard sheets and sending a result of the counting to the upper-level management device 100, according to the control instruction information sent from the upper-level management device 100. The low-level management device 110 is connected to a program memory 120 and a working memory 130, and makes up a computer for controlling the corrugated paperboard sheet box making machine 1 according to this embodiment, in cooperation with the memories 120, 130. The program memory 120 is configured to fixedly store therein data such as a control program for controlling the entire corrugated paperboard sheet box making machine 1, and predetermined set values. The working memory 130 is configured to temporarily store therein various information sent from the upper-level management device 100, and a result of arithmetic processing, during execution of the control program.

The low-level management device 110 is connected to an operation panel 140. The operation panel 140 has a sheet feed button 141, and an order termination button 142. The sheet feed button 141 is designed to be manually operated to cause the sheet feed unit 20 to start feeding of the corrugated paperboard sheet SH. The order termination button 142 is designed to be manually operated to terminate a currently executed order.

<Content stored in Correction Memory>

The low-level management device 110 is connected to a correction memory 150. The correction memory 150 is configured to store therein a plurality of correction information, in association with a total basis weight of a corrugated paperboard sheet to be processed, and a conveyance direction-wise sheet length of the corrugated paperboard sheet. FIG. 5 presents correction information stored in the correction memory 150. In this embodiment, as illustrated in FIG. 5, the correction memory 150 is divided into 5 storage regions corresponding to the printing units 4A to 4C, the slotter device 6 and the die-cutter device 7, respectively. The total basis weight of the corrugated paperboard sheet means a weight per unit area of a sum of a liner and a corrugating medium making up the corrugated paperboard sheet. In this embodiment, the total basis weight is classified into the following 6 levels: "LL", "L", "M", "H", "H H" and "HHH". For example, the total basis weights in "LL", "L", "M", "H", "HH" and "HHH" are "400 g or less", "401 g to 460 g", "461 g to 519 g", "520 g to 599 g", "600 g to 680 g" and "681 g or more", respectively. Further, in this embodiment, the sheet length presented in FIG. 5 is classified into the following 4 levels: "450 mm or less", "451 to 900 mm", "901 to 1200 mm" and "1201 mm or more".

A processing position where each of the printing units 4A to 4C, the slotter device 6 and the die-cutter device 7 perform a processing process on a corrugated paperboard sheet deviates from a desired position, as mentioned above. Thus, the correction information stored in the correction memory 150 is set to correct such a deviation of processing position. In order to prevent un-dried printing ink on a printed corrugated paperboard sheet from adhering to another corrugated paperboard sheet to be printed through a next printing process. Although each of the printing units 4A to 4C is configured to convey a corrugated paperboard sheet while suckingly holding the corrugated paperboard sheet, a slipping occurs between the group of conveyance rollers 33A to 33C and the corrugated paperboard sheet, causing a delay in a timing at which the corrugated paperboard sheet reaches each of the printing units.

As a result of various experimental tests, the inventors found that there is a certain relationship between a total basis weight of a corrugated paperboard sheet, and a deviation amount of conveyance as the phenomenon that a timing at which a corrugated paperboard sheet reaches each of the printing units gets delayed. The test result showed that a deviation amount of conveyance is apt to become larger as the total basis weight becomes larger, and apt to become smaller as the sheet length becomes larger. The correction information to be stored in the correction memory 150 is preliminarily set, based on deviation amounts of conveyance occurring in five processing regions of the printing units 4A to 4C, the slotter device 6 and the die-cutter device 7, measured while variously changing respective values of the total basis weight and the sheet length. A total deviation amount of conveyance occurring in the entire printing region of the printing unit 4A disposed upstream of the printing unit 4B is equal to a deviation amount of conveyance occurring in the processing region of the printing unit 4B. Further, a total deviation amount of conveyance occurring in the entire processing region of the printing unit 4B disposed upstream of the printing unit 4C is equal to a deviation amount of conveyance occurring in the processing region of the printing unit 4C.

As presented in FIG. 5, a value of the correction information becomes larger as the total basis weight increases from "LL" toward "HHH". Further, the value of the correction information becomes smaller as the sheet length increases from "450 mm or less" toward "1201 mm or more". For example, in the correction information for the printing unit 4A, values associated with the sheet length "450 mm or less" and respective ones of the total basis weights "LL" to "HHH" are "1", "1", "1", "2", "3" and "4". Values of the correction information associated with the total basis weights "LL", "L" and "M" are set to the same value, whereas the value of the correction information become larger as the total basis weight increased from "LL" toward "HHH". On the other hand, in the correction information for the printing unit 4A, values associated with the total basis weight "HH" and respective ones of the sheet lengths "450 mm or less" to "1201 mm or more" are "3", "2", "2" and "1". Values of the correction information associated with the sheet lengths "451 to 900 mm" and "901 to 1200 mm" are set to the same value, whereas the value of the correction information become smaller as the sheet length increases from "450 mm or less" toward "1201 mm or more". A value of the correction information for each of the printing units 4B, 4C, the slotter device 6 and the die-cutter device 7 becomes larger as the total basis weight increases from "LL" toward "HHH", and becomes smaller as the sheet length increases from "450 mm or less" toward "1201 mm or more", as with the value of the correction information for the printing unit 4A.

Each of the creaser-related conveyance section 31 and the slotter-related conveyance section 32 is configured to convey the corrugated paperboard sheet SH while clamping it by a pair of conveyance rolls. Thus, as compared to the printing-related conveyance sections 30A to 30C each configured to convey the corrugated paperboard sheet SH while suckingly holding it, a slipping between the group of conveyance rolls and the corrugated paperboard sheet SH is small, and almost no deviation of conveyance occurs during a period in which the corrugated paperboard sheet SH is conveyed by the creaser-related conveyance section 31 and the slotter-related conveyance section 32. For this reason, in this embodiment, as presented in FIG. 5, the correction information stored in corresponding relation to the slotter device 6 is set to the same value as that of the correction information stored in corresponding relation to the die-cutter device 7. However, the correction information stored in corresponding relation to the slotter device 6 is set to a larger value than that of the correction information stored in corresponding relation to the printing unit 4C. The value of the correction information changes due to a conveyance structure and a conveyance direction-wise length of each conveyance section of the conveyance device 3. For example, in this embodiment, a delay amount of conveyance becomes relatively large, because there is a situation in which a suction force of the printing-related conveyance section 30C partly acts on the corrugated paperboard sheet being conveyed from the printing unit 4C toward the slotter device 6. Thus, an increment of the correction information to be stored in corresponding relation to the printing unit 4C toward the slotter device 6 is set to a larger value than that of the correction information to be stored in corresponding relation to the printing units 4B, 4C.

<Controller>

The low-level management device 110 is connected to each of a drive controller 160, first to third controllers 161 to 163, first and second slotter controllers 164, 165 and a die-cutter controller 166. Although not illustrated in FIG. 2, the low-level management device 110 is also connected to a controller for drivingly controlling the blower motors of the suction mechanisms 34A to 34C of the printing-related conveyance sections 30A to 30C. The drive controller 160 is operable, according to control instruction information from the low-level management device 110, to control drive and stop of the primary drive motor MT, and a motor speed of the primary drive motor MT. Each of the first to third controllers 161 to 163 is operable, according to control instruction information from the low-level management device 110, to control an operation of the printing unit (4A, 4B, 4C), and control drive and stop of the differential motor 45A, 45B, 45C), and a motor speed of the differential motor 45A , 45B, 45C). Each of the first and second slotter controllers 164, 165 is operable, according to control instruction information from the low-level management device 110, to control an operation of the slotter units (6A, 6B), and control drive and stop of the differential motor (64A, 64B), and a motor speed of the differential motor (64A, 64B). The die-cutter controller 166 is operable, according to control instruction information from the low-level management device 110, to control an operation of the die-cutter device 7, and control drive and stop of the differential motor 73, and a motor speed of the differential motor 73.

<Encoder and Sensor>

Six encoders EC1 to EC6 are connected, respectively, to rotary shafts of the differential motors 45A to 45C, 64A, 64B, 73, so as to detect an amount and direction of rotation in each of these differential motors. Six reference point sensors SN1 to SN6 are installed to detect reference points RP1 to RP6 each set on a respective one of the printing cylinders 40A to 40C of the printing units 4A to 4C, the upper slotters 60A, 60B of the slotter units 6A, 6B and the die cylinder 70 of the die-cutter device 7.

The reference point sensor SN1 is fixed to the frame of the printing unit 4A, and operable, when the printing cylinder 40A reaches a given rotation phase illustrated in FIG. 2, to detect the reference point RP1 set on the printing cylinder 40A. That is, the reference point RP1 is set on the printing cylinder 40A, in such a manner that, when a leading edge of the corrugated paperboard sheet SH is conveyed from the sheet feeding unit 20 by the distance L1, and reaches an installation position DP1 where the printing cylinder 40A and the press roll 43A are installed in opposed relation to each other, a leading edge of the printing member 41A in a rotation direction of the printing cylinder 40A also reaches the installation position DP1. The reference point sensor SN2 is fixed to the frame of the printing unit 4B, and operable, when the printing cylinder 40B reaches a given rotation phase illustrated in FIG. 2, to detect the reference point RP2 set on the printing cylinder 40B. That is, the reference point RP2 is set on the printing cylinder 40B, in such a manner that, when the leading edge of the corrugated paperboard sheet SH is conveyed from the sheet feeding unit 20 by the distance L2, and reaches an installation position DP2 where the printing cylinder 40B and the press roll 43B are installed in opposed relation to each other, a leading edge of the printing member 41 B in a rotation direction of the printing cylinder 40B also reaches the installation position DP2. The reference point sensor SN3 is fixed to the frame of the printing unit 4C, and operable, when the printing cylinder 40C reaches a given rotation phase illustrated in FIG. 2, to detect the reference point RP3 set on the printing cylinder 40C. That is, the reference point RP3 is set on the printing cylinder 40C, in such a manner that, when the leading edge of the corrugated paperboard sheet SH is conveyed from the sheet feeding unit 20 by the distance L3, and reaches an installation position DP3 where the printing cylinder 40C and the press roll 43C are installed in opposed relation to each other, a leading edge of the printing member 41C in a rotation direction of the printing cylinder 40C also reaches the installation position DP3.

The reference point sensor SN4 is fixed to a frame of the slotter unit 6A, and operable, when the upper slotter 60A reaches a given rotation phase illustrated in FIG. 3, to detect the reference point RP4 set on the upper slotter 60A. That is, the reference point RP4 is set on the upper slotter 60A, in such a manner that, when the leading edge of the corrugated paperboard sheet SH is conveyed from the sheet feeding unit 20 by the distance L4, and reaches an installation position DP4 where the upper slotter 60A and the lower slotter 61A are installed in opposed relation to each other, a leading edge of the slotter blade 62A in a rotation direction of the upper slotter 60A also reaches the installation position DP4.

The reference point sensor SN5 is fixed to a frame of the slotter unit 6B, and operable, when the upper slotter 60B reaches a given rotation phase illustrated in FIG. 3, to detect the reference point RP5 set on the upper slotter 60B. That is, the reference point RP5 is set on the upper slotter 60B, in such a manner that, when the leading edge of the corrugated paperboard sheet SH is conveyed from the sheet feeding unit 20 by the distance L5, and reaches an installation position DP5 where the upper slotter 60B and the lower slotter 61B are installed in opposed relation to each other, a leading edge of the slotter blade 62B in a rotation direction of the upper slotter 60B also reaches the installation position DP5. The reference point sensor SN6 is fixed to a frame of the die-cutter device 7, and operable, when the die cylinder 70 reaches a given rotation phase illustrated in FIG. 3, to detect the reference point RP6 set on the die cylinder 70. That is, the reference point RP6 is set on the die cylinder 70, in such a manner that, when the leading edge of the corrugated paperboard sheet SH is conveyed from the sheet feeding unit 20 by the distance L6, and reaches an installation position DP6 where the die-cylinder 70 and the anvil cylinder 71 are installed in opposed relation to each other, a leading edge of the punching die 72 in a rotation direction of the die cylinder 70 also reaches the installation position DP6.

<<Operation and Function of Embodiment>>

An operation and function of the corrugated paperboard sheet box making machine 1 according to this embodiment will be described below. Operations of the corrugated paperboard sheet box making machine 1 for processing the corrugated paperboard sheet SH fed out from the sheet feeding device 2 through various processing processes, such as printing, scoring/creasing, slotting and punching are publicly known, for example, by JP 2000-062981A. Thus, only an operation and function of correcting a printing timing and a machining timing in advance of executing these processing processes will be described.

The upper-level management device 100 sends, the low-level management device 110, control instruction information regarding a plurality of orders to be sequentially executed. According to the control instruction information, the low-level management device 110 sends control instruction information for executing the orders, to the controllers 160 to 166. When an operator manually operates the order termination button 142 of the operation panel 140, the low-level management device 110 executes an order termination processing for terminating an order being currently executed, in response to the order termination operation. As the order termination processing, based on a detection signal from a non-illustrated sensor, the low-level management device 110 conforms that no corrugated paperboard sheet SH exists in the sheet feeding unit 20, and then confirms that a last corrugated paperboard sheet in the order being currently executed is discharged from an exit. After performing the above confirmation operation, the low-level management device 110 stops the entire operations of the corrugated paperboard sheet box making machine 1.

During a period in which the entire operations of the corrugated paperboard sheet box making machine 1 is stopped, the operator replaces the printing plates of the printing plate members 41A to 41C of the printing units 4A to 4C, and the punching die 72 of the die-cutter device 7, with different printing plates and punching die for an upcoming order. After completion of the replacement work, the operator manually operates a non-illustrated correction execution button. In response to this operation, the low-level management device 110 starts an operation of correcting a printing timing and a processing timing for the upcoming order.

Firstly, the low-level management device 110 temporality stores the control instruction information received from the upper-level management device 100, in the working memory 130. Then, in connection with the upcoming order, the low-level management device 110 extracts basis weight information indicative of a total basis weight of a corrugated paperboard sheet, and sheet length information indicative of a conveyance direction-wise length of the corrugated paperboard sheet, from the stored control instruction information.

Based on the extracted basis weight information and sheet length information, the low-level management device 110 reads correction information from the correction memory 150. For example, suppose that the corrugated paperboard sheet is formed from a double faced corrugated paperboard, wherein the total basis weight of a corrugating medium and two liners is "650 g", and the conveyance direction-wise sheet length is "750 mm". In this case, based on basis weight information indicative of "650 g" and sheet length information indicative of "750 mm", the low-level management device 110 reads, from the correction memory 150, correction information associated with the total basis weight "HH" and the sheet length "451 to 900 mm" and in corresponding relation to the slotter device 6 and the die-cutter device 7, and temporarily stores the read correction information in the working memory 130. The correction information corresponding to the printing units 4A to 4C is "2", "3" and "5". Further, the correction information corresponding to the slotter device 6 is "7",and the correction information corresponding to the die-cutter device 7 is "7".

Further, in connection with the upcoming order, the low-level management device 110 extracts slot-depth information indicative of a depth of a slot to be formed in each of front and rear ends of the corrugated paperboard sheet, from the control instruction information stored in the working memory 130. Then, based on the extracted sheet length information and the extracted slot depth information, the low-level management device 110 changes the correction information temporarily stored in the working memory 130 in corresponding relation to the slotter device 6. For example, with regard to the slotter unit 6A for forming a slot in the front end of the corrugated paperboard sheet, a difference between a length of the slotter blade 62A in the rotation direction of the upper slotter 60A and the slot depth is subtracted from a value indicated by the correction information, and a result of the subtraction is temporarily stored in the working memory 130, as front-end change information. Further, with regard to the slotter unit 6B for forming a slot in the rear end of the corrugated paperboard sheet, a difference between the sheet length and the slot depth is added to a value indicated by the correction information, and a result of the addition is temporarily stored in the working memory 130, as rear-end change information.

The low-level management device 110 sends a reference-point positioning instruction to the controllers 161 to 166 to instruct the controllers 161 to 166 to control the printing cylinders 40A to 40C, the upper slotters 60A, 60B and the die cylinder 70 in such a manner as to be rotated to and positioned at respective positions where the reference points PR1 to PR6 can be detected by the reference point sensors SN1 to SN6, respectively. Each of the controllers 161 to 166 operates, according to the reference-point positioning instruction, to rotate a respective one of the differential motors 45A to 45C, 64A, 6B, 73. Then, based on detection signals from the reference point sensors SN1 to SN6, each of the controllers 161 to 166 confirms that the printing cylinders 40A to 40C, the upper slotters 60A, 60B and the die cylinder 70 reach the reference points PR1 to PR6, respectively. Upon the confirmation, each of the controllers 161 to 166 operates to stop rotation of a respective one of the differential motors 45A to 45C, 64A, 6B, 73. Thus, as illustrated in FIGS. 2 and 3, the reference points PR1 to PR6 on the printing cylinders 40A to 40C, the upper slotters 60A, 60B and the die cylinder 70 are positioned at given reference rotation phases where they are opposed to the reference point sensors SN1 to SN6, respectively.

After completion of positioning at the given reference rotation phases, based on the correction information and the change information temporarily stored in the working memory 130, the low-level management device 110 executes a correction operation of changing respective rotation phases of the printing cylinders 40A to 40C, the upper slotters 60A, 60B and the die cylinder 70, from the given reference rotation phases. For example, the low-level management device 110 sends the temporarily stored correction information to the first controller 161, and instructs the first controller 161 to correct the rotation phase of the printing cylinder 40A. According to the value "2" indicated by the received correction information, the first controller 161 controls an amount and direction of rotation of the differential motor 45A. Then, based on a detection signal from the encoder EC1, the first controller 161 stops the rotation of the differential motor 45A when the differential motor 45A rotates by an amount of rotation equivalent to the value of the correction information. As with the first controller 161, each of the second and third controller 162, 163 controls an amount and direction of rotation of the differential motor (45B, 45C), according to the value ("3", "5") indicated by the correction information received from the low-level management device 110. Then, each of the second and third controller 162, 163 stops the rotation of the differential motor (45B, 45C) based on a detection signal from the encoder (EC2, EC3), when the differential motor (45B, 45C) rotates by an amount of rotation equivalent to the value of the correction information.

Further, the low-level management device 110 sends the temporarily stored front-end change information to the first slotter controller 164, and instructs the first slotter controller 164 to correct the rotation phase of the upper slotter 60A. According to the value indicated by the received front-end change information, the first slotter controller 164 controls an amount and direction of rotation of the differential motor 64A. Then, based on a detection signal from the encoder EC4, the first slotter controller 164 stops the rotation of the differential motor 64A when the differential motor 64A rotates by an amount of rotation equivalent to the value of the front-end change information. As with the first slotter controller 164, the second slotter controller 165 controls an amount and direction of rotation of the differential motor 64B according to the value indicated by the rear-end change information received from the low-level management device 110. Then, based on a detection signal from the encoder EC5, the second slotter controller 165 stops the rotation of the differential motor 64B when the differential motor 64B rotates by an amount of rotation equivalent to the value of the rear-end change information.

Further, the low-level management device 110 sends the temporarily stored correction information to the die-cutter controller 166, and instructs the die-cutter controller 166 to correct the rotation phase of the die cylinder 70. According to the value "7" indicated by the received correction information, the die-cutter controller 166 controls an amount and direction of rotation of the differential motor 73. Then, based on a detection signal from the encoder EC6, the die-cutter controller 166 stops the rotation of the differential motor 73 when the differential motor 73 rotates by an amount of rotation equivalent to the value of the correction information.

After confirming the completion of the correction operation through a display of a non-illustrated display device, the operator loads the sheet feeding unit 20 with corrugated paperboard sheets SH. In this state, when the operator manually operates the sheet feed button 141 of the operation panel 140, the low-level management device 110 instructs the drive controller 160 to drive the primary drive motor MT so as to execute a next order. Thus, the primary drive motor MT is driven, and the sheet feeding device 3 starts a sheet feeding operation. Simultaneously, the conveyance device 3, the printing device 4, the creaser device 5, the slotter device 6 and the die-cutter device 7 are activated by drive of the primary drive motor MT. In this embodiment, the suction force of each of the suction mechanisms 34A to 34C of the printing-related conveyance sections 30A to 30C of the conveyance device 3 is set to a constant value, irrespective of a total basis weight of a corrugated paperboard sheet.

<Specific Example of Correction Operation>

Figure 6:
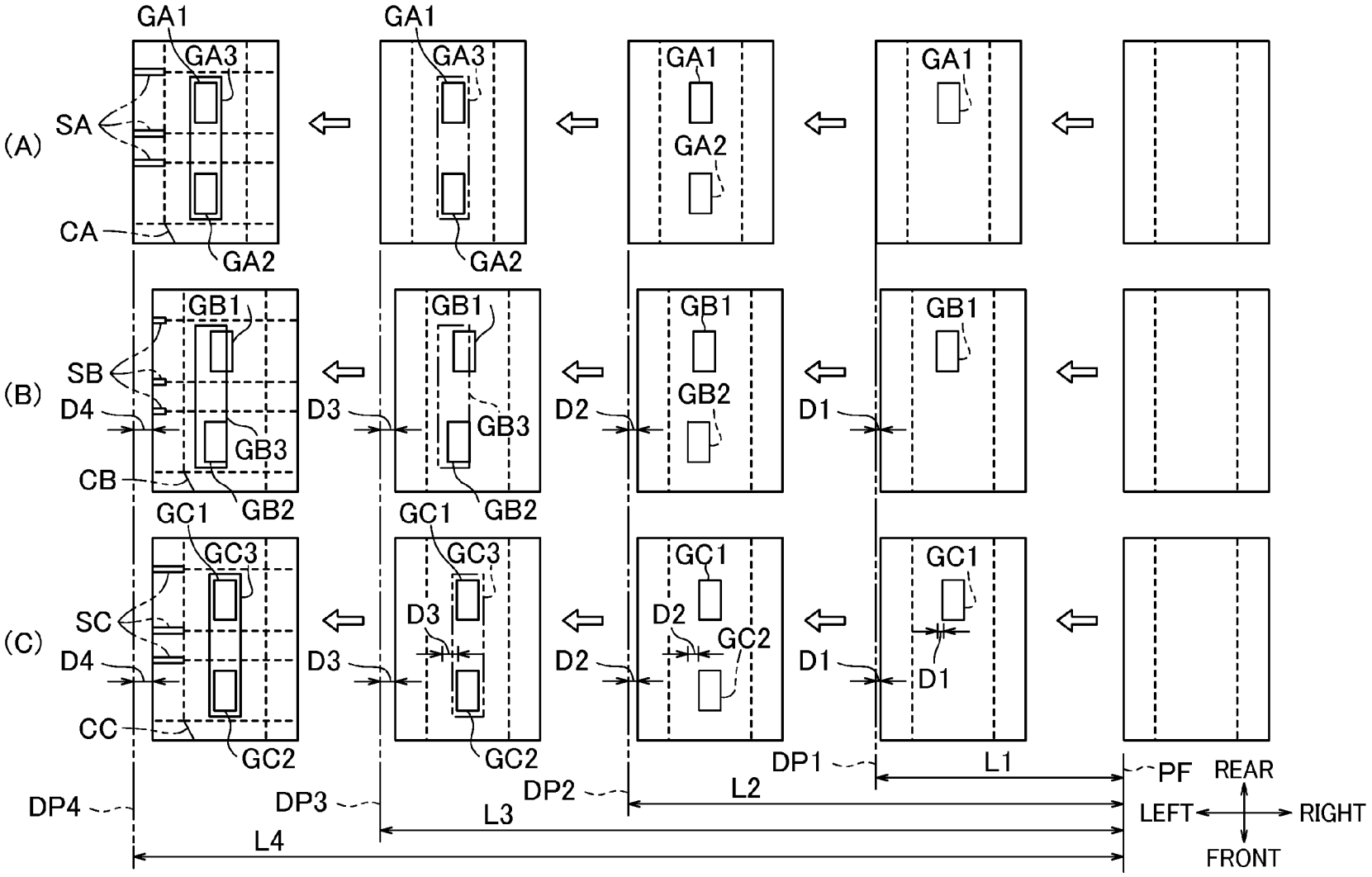
FIG. 6(A) is a process diagram in an ideal state in which no delay of conveyance occurs during conveyance of a corrugated paperboard sheet.
FIG. 6(B) is a process diagram in a state in which no correction operation is performed although a delay of conveyance occurs during conveyance of a corrugated paperboard sheet.
FIG. 6(C) is a process diagram in a state in which a delay of conveyance occurs during conveyance of a corrugated paperboard sheet, and a correction operation for the delay of conveyance is performed.

A specific example of the correction operation, mainly a correction operation of correcting the rotation phase of each of the printing cylinders 40A to 40C, will be described below. FIGS. 6(A), 6(B) and 6(C) schematically illustrate a process of printing a corrugated paperboard sheet SH, while being conveyed from the sheet feed start position PF set at the installation position of the front gate 24 of the sheet feeding unit 20, to the installation position DP4 of the slotter unit 6A, through the installation position DP1 of the printing unit 4A, the installation position DP2 of the printing unit 4B and the installation position DP3 of the printing unit 4C in this order. FIG. 6(A) illustrates a process in an ideal state in which no delay of conveyance occurs during conveyance of a corrugated paperboard sheet SH by the printing-related conveyance sections 30A to 30C. FIG. 6(B) illustrates a process in a non-corrected state in which no correction operation is performed although a delay of conveyance occurs. FIG. 6(C) illustrates a process in a corrected state in which a delay of conveyance occurs, and a correction operation for the delay of conveyance is performed. In FIG. 6, a conveyance direction of a corrugated paperboard sheet SH is directed from the right side toward the left side.

In FIG. 6, when a leading edge of the corrugated paperboard sheet SH reaches the installation position DP1, a delay amount D1 of conveyance occurs. In FIGS. 6(A), 6(B) and 6(C), an image to be printed by the printing unit 4A is designated by GA1, GB1 and GC1. As compared to the image GA1 illustrated in FIG. 6(A), the image GB1 illustrated in FIG. 6(B) is formed on the corrugated paperboard sheet in such a manner as to deviate leftwardly by the delay amount D1 of conveyance. When the rotation phase of the printing cylinder 40A is corrected by the correction information, the image GB1 is formed such that it is moved rightwardly by the delay amount D1 of conveyance, as illustrated in FIG. 6(C). Thus, an image position deviation due to the delay amount D1 of conveyance is eliminated.

When the leading edge of the corrugated paperboard sheet SH reaches the installation position DP2, a delay amount D2 of conveyance occurs. Then, when the leading edge of the corrugated paperboard sheet SH reaches the installation position DP3, a delay amount D3 of conveyance occurs. In FIGS. 6(A), 6(B) and 6(C), an image to be printed by the printing unit 4B is designated by GA2, GB2 and GC2, and an image to be printed by the printing unit 4C is designated by GA3, GB3 and GC3. As compared to the image GA2 illustrated in FIG. 6(A), the image GB2 illustrated in FIG. 6(B) is formed on the corrugated paperboard sheet in such a manner as to deviate leftwardly by the delay amount D2 of conveyance. Further, as compared to the image GA3 illustrated in FIG. 6(A), the image GB3 illustrated in FIG. 6(B) is formed on the corrugated paperboard sheet in such a manner as to deviate leftwardly by the delay amount D3 of conveyance. When the rotation phase of each of the printing cylinder 40B, 40C is corrected by the correction information, the image GB2 is formed such that it is moved rightwardly by the delay amount D2 of conveyance, and the image GB3 is formed such that it is moved rightwardly by the delay amount D3 of conveyance. Thus, an image position deviation due to the delay amount D2 (D3) of conveyance is eliminated.

When the leading edge of the corrugated paperboard sheet SH reaches the installation position DP4, a delay amount D4 of conveyance occurs. In FIGS. 6(A), 6(B) and 6(C), a slot to be firmed in the front edge of the corrugated paperboard sheet SH by the slotter unit 6A is designated by SA, SB and SC. Further, in FIGS. 6(A), 6(B) and 6(C), a notch (cutout) for forming a joint flap of the corrugated paperboard sheet SH by the slotter unit 6A is designated by CA, CB and CC. As compared to the depth of the slot SA illustrated in FIG. 6(A), the depth of the slot SB illustrated in FIG. 6(B) becomes shorter by the delay amount D4 of conveyance. When the rotation phase of the upper slotter 60A of the slotter unit 6A is corrected by the correction information, each of the slot SC and the notch CC is formed such that it is moved rightwardly by the delay amount D4 of conveyance. Thus, deviations of slot and notch positions due to the delay amount D4 of conveyance are eliminated.

A slot and notch formed by the upper slotter 60B of the slotter unit 6B can also be moved according to the correction information in the same manner as that in the slot and notch formed by the upper slotter 60A. Thus, deviations of slot and notch positions due to a delay amount of conveyance are eliminated. Further, a punched-hole formed by the die cylinder 70 of the die-cutting device 7 can also be moved according to the correction information in the same manner as that in the print image formed by the printing cylinder. Thus, a deviation of punched-hole position due to a delay amount of conveyance is eliminated.

<<Advantageous Effects of Embodiment>>

In this embodiment, the correction memory 150 stores therein correction information in association with basis weight information and sheet length information. A value of the correction information is preliminarily set through experimental tests, based on a certain relationship in which the delay amount of conveyance changes depending on a total basis weight and sheet length of a corrugated paperboard sheet. In order to execute each order, the correction information associated with a total basis weight and sheet length of a corrugated paperboard sheet to be processed through a processing process such as a printing process is read from the correction memory 150. A rotation phase of the printing cylinder, etc., is set according to the correction information. Thus, it becomes possible to eliminate a need to feed a pilot sheet and calculate a deviation amount of processing position, in a preparation stage prior to start of processing process, and easily set the rotation phase of the printing cylinder, etc.

In this embodiment, the rotation phase of the printing cylinder, etc., is changed, i.e., delayed, from a given reference rotation phases in a direction opposite to the printing cylinder, etc., depending on the delay amount of conveyance of a corrugated paperboard sheet. A value of the correction information stored in the correction memory 150 represents a delay amount of rotation phase of the printing cylinder, etc. As illustrated in FIG. 5, the value of the correction information becomes larger as the total basis weight increases from "LL" toward "HHH". Further, the value of the correction information becomes smaller as the sheet length increases from "450 mm or less" toward "1201 mm or more". It is considered that a rigidity of a corrugated paperboard sheet becomes larger as the corrugated paperboard sheet has a larger total basis weight. Thus, in a situation where a corrugated paperboard sheet is suckingly held by the suction mechanisms 34A to 34C, it becomes less likely to be deformed, so that a contact area between the corrugated paperboard sheet and each of the large number of conveyance rollers 33A to 33C becomes smaller, and a slipping therebetween is more likely to occur. On the other hand, as the corrugated paperboard sheet has a larger sheet length, it is suckingly held in a wider range of the conveyance path by the suction mechanisms 34A to 34C, and a total suction force applied to the corrugated paperboard sheet becomes larger, so that a slipping between the corrugated paperboard sheet and each of the large number of conveyance rollers 33A to 33C is less likely to occur. Thus, a value of the correction information is set according to the total basis weight and the sheet length as presented in FIG. 5, so that it becomes possible to set the rotation phase of the printing cylinder, etc., in conformity to the delay amount of conveyance which varies depending of a type of corrugated paperboard sheet.

[Modifications]

While the present invention has been described with reference to the specific embodiment thereof, it will be understood by those skilled in the art that various changes and modifications may be made therein without departing from the spirit and scope of the present invention as set forth in appended claims.

(1) In the above embodiment, the printing units 4A to 4C, the creaser device 5, the slotter units 6A, 6B and the die-cutter device 7 are coupled to the primary drive motor MT via the power transmission mechanism. Then, the rotation phases of the printing cylinders 40A to 40C, the upper slotters 60A, 60B and the die-cutter device 7 are adjusted by the differential mechanisms 44A to 44C, 63A, 63B, 73 and the differential motors 45A to 45C, 64A, 64B, 74. The printing cylinders of the printing units, the upper slotters of the slotter units and the die cylinder of the die-cutter device may be configured to be driven by a plurality of servomotors, individually, instead of the primary drive motor MT in the above embodiment. In this case, in place of the differential mechanisms and the differential motors in the above embodiment, it is possible to employ a configuration designed to variably control a motor speed of each of the servomotors, thereby adjusting the rotation phase of the printing cylinder or the like. In the configuration designed to variably control a motor speed of each of the servomotors, the rotation phase of the printing cylinder or the like is set to a given reference rotation phase once according to the rotation control of the servomotors. Then, the printing cylinder or the like is initially subjected to variable control of rotational speed, according to the correction information, and then rotationally driven at the same circumferential velocity as that of a feed roll of the sheet feeding device.

(2) In the above embodiment, only each of the printing-related conveyance sections 30A to 30C is configured to be equipped with the suction mechanism (34A to 34C). Alternatively, each the creaser-related conveyance section 31 and the slotter-related conveyance section 32 may also be equipped with a suction mechanism.

(3) In the above embodiment, the correction memory 150 is configured to store therein the correction information in association with the total basis weight and the sheet length as a length of the corrugated paperboard sheet in the conveyance direction. Alternatively, the correction memory may be configured to store therein the correction information in association with the total basis weight, and a width of the corrugated paperboard sheet in a direction perpendicular to the conveyance direction, or may be configured to store therein the correction information in association with the total basis weight, and a surface area of the corrugated paperboard sheet. Further, in the above embodiment, respective values of the correction information to be stored in connection with the slotter device 6 and the die-cutter device 7 are set to the same value. However, considering a delay amount of conveyance due to a slopping between the corrugated paperboard sheet and each conveyance roll of the slotter-related conveyance section 32 even through the slipping is relatively small, a value of the correction information to be stored in connection with the die-cutter device 7 may be set to be greater than that of the correction information to be stored in connection with the slotter device 6.

(4) In the above embodiment, the correction memory 150 is incorporated in the corrugated paperboard sheet box making machine 1. Alternatively, the correction memory may be composed of an external memory configured to be accessible by a controller such as the low-level management device 110 of the corrugated paperboard sheet box making machine 1, via a network such as the Internet.

(5) In the above embodiment, the low-level management device 110 is configured to, in response to a operator's manual operation of the correction execution button of the operation panel 140, set a rotation phase of each of the printing cylinders, the upper slotters and the die cylinder, according to the correction information and the change information, for an upcoming order. Alternatively, a configuration may be employed which is configured to, according to the correction information and the change information, automatically set the rotation phase of each of the printing cylinders, the upper slotters and the die cylinder, wherein one the printing cylinders, the upper slotters and the die cylinder is subjected to the setting operation in an earlier timing as it rotational stops at a earlier timing in a period after an operator manually operates the order termination button 142 of the operation panel 140 through until the operator manually operates the sheet feed button 141 of the operation panel 140. Alternatively, a configuration may be employed which is configured to set the rotation phase of the printing cylinder or the like, according to the correction information and the change information, when an operator manually operates the sheet feed button 141 of the operation panel 140.

In the above embodiment, the upper-level management device 100 is configured to, in order to sequentially execute a plurality of orders, send, to the low-level management device 110, the control instruction information regarding each order, including the basis weight information indicative of a total basis weight of a corrugated paperboard sheet, and the sheet length information indicative of a length of the corrugated paperboard sheet in the conveyance direction. Alternatively, an operator may manually operate the operation panel 140 to set the basis weight information and the sheet length information.

What is claimed is:

1. A corrugated paperboard sheet printing device comprising:

a conveyance device for conveying, along a conveyance path, a corrugated paperboard sheet fed out from a sheet feeding device, while suckingly holding the corrugated paperboard sheet;

a plurality of printing units arranged along the conveyance path and for printing the corrugated paperboard sheet through a series of printing processes;

a first storage device for storing basis weight information indicative of a basis weight of a corrugated paperboard sheet respectively;

a second storage device for storing a plurality of correction information for correcting a plurality of printing timings at each of which a respective one of the plurality of printing units performs the printing process on the corrugated paperboard sheet, in association with the basis weight information indicative of the basis weight of the corrugated paperboard sheet; and a controller for, based on the correction information stored in association with the basis weight information of the corrugated paperboard sheet, correcting the printing timing in each of the printing units, and causing the printing unit to operate according to the corrected printing timing;

wherein the storage device is configured to store the correction information in association with the basis weight information of the corrugated paperboard sheet, as information for performing the correction in such a manner that an amount of correction time in each of the printing units becomes larger as the corrugated paperboard sheet has a larger basis weight.

2. The corrugated paperboard sheet printing device as defined in claim 1, wherein the second storage device is operable to further store sheet length information indicative of a conveyance direction-wise sheet length of a corrugated paperboard sheet respectively, and wherein the second storage device is configured to store the correction information in association of the basis weight information indicative of the basis weight of the corrugated paperboard sheet, and the sheet length information indicative of the sheet length of the corrugated paperboard sheet.

3. The corrugated paperboard sheet printing device as defined in claim 2, wherein the second storage device is configured to store the correction information in association with the basis weight information and the sheet length information of the corrugated paperboard sheet, as information for performing the correction in such a manner that the amount of correction time in each of the printing units becomes larger as the corrugated paperboard sheet has a larger basis weight, and become smaller as the corrugated paperboard sheet has a larger conveyance direction-wise sheet length.

4. The corrugated paperboard sheet printing device as defined in claim 2, wherein the second storage device is configured to store the correction information in association with the basis weight information and the sheet length information of the corrugated paperboard sheet, as information for performing the correction in such a manner that the amount of correction time in each of the printing units is cumulatively increased as the printing unit is located on a farther downstream side of the arrangement along the conveyance path.

5. The corrugated paperboard sheet printing device as defined in claim 1, wherein the second storage device is configured to store the correction information in association with the basis weight information of the corrugated paperboard sheet, as information for performing the correction in such a manner that the amount of correction time in each of the printing units is cumulatively increased as the printing unit is located on a farther downstream side of the arrangement along the conveyance path.

6. The corrugated paperboard sheet printing device as defined in claim 1, wherein each of the plurality of printing units comprises: a printing cylinder rotatable to perform the printing process on the corrugated paperboard sheet; and a timing adjuster for adjusting a printing timing of the printing cylinder, with respect to a feed-out start timing at which a corrugated paperboard sheet is fed out from the sheet feeding device, and wherein the controller is operable to control the timing adjuster, thereby correcting the printing timing in each of the printing units, and causing the printing unit to operate according to the correct printing timing.

7. A corrugated paperboard sheet printing device comprising:

a conveyance device for conveying, along a conveyance path, a corrugated paperboard sheet fed out from a sheet feeding device, while suckingly holding the corrugated paperboard sheet;

a plurality of printing units arranged along the conveyance path and for printing the corrugated paperboard sheet through a series of printing processes;

a setting device to allow an operator to set basis weight information indicative of a basis weight of a corrugated paperboard sheet respectively, and sheet length information indicative of a conveyance direction-wise sheet length of the corrugated paperboard sheet; and a controller for, based on the basis weight information and the sheet length information each set by the operator, correcting the printing timing in each of the printing units, and causing the printing unit to operate according to the corrected printing timing;

wherein the controller is adapted to perform the correction in such a manner that an amount of correction time in each of the printing units becomes larger as the corrugated paperboard sheet has a larger basis weight.

8. A corrugated paperboard sheet printing device comprising:

a conveyance section for conveying, along a conveyance path, a corrugated paperboard sheet fed out from a sheet feeding device;

a plurality of printing units arranged along the conveyance path and for printing the corrugated paperboard sheet through a series of printing processes;

a plurality of machining units arranged along the conveyance path to machining, through a series of machining processes, the corrugated paperboard sheet after being printed through the series of printing processes by the plurality of printing units;

a first storage device for storing basis weight information indicative of a basis weight of a corrugated paperboard sheet respectively;

a second storage device for storing a plurality of correction information for correcting a plurality of printing timings at each of which a respective one of the plurality of printing units performs the printing process on the corrugated paperboard sheet, and a plurality of machining timings at each of which a respective one of the plurality of machining units performs the machining process on the corrugated paperboard sheet, in association with the basis weight information indicative of the basis weight of the corrugated paperboard sheet; and a controller for, based on the correction information stored in association with the basis weight information of the corrugated paperboard sheet, correcting the printing timing in each of the printing units and the machining timing in each of the machining units, and causing the printing unit and the machining unit to operate according to the corrected printing timing and the corrected machining timing, respectively, wherein the conveyance device is operable to convey the corrugated paperboard sheet while suckingly holding the corrugated paperboard sheet, in a region where the plurality of printing units are arranged.

9. A management device for a corrugated paperboard sheet box making machine, the corrugated paperboard sheet box making machine comprising: a conveyance device for conveying, along a conveyance path, a corrugated paperboard sheet fed out from a sheet feeding device; a plurality of printing units arranged along the conveyance path to print the corrugated paperboard sheet through a series of printing processes; and a plurality of machining units arranged along the conveyance path to machine, through a series of machining processes, the corrugated paperboard sheet after being printed through the series of printing processes by the plurality of printing units, wherein the conveyance device is operable to convey the corrugated paperboard sheet while suckingly holding the corrugated paperboard sheet, in a region where the plurality of printing units are arranged, the management device comprising:

a first storage device for storing basis weight information indicative of a basis weight of a corrugated paperboard sheet respectively;

a second storage device for storing therein a plurality of correction information for correcting a plurality of printing timings at each of which a respective one of the plurality of printing units performs the printing process on the corrugated paperboard sheet, and a plurality of machining timings at each of which a respective one of the plurality of machining units performs the machining process on the corrugated paperboard sheet, in association with the basis weight information indicative of the basis weight of the corrugated paperboard sheet; and a controller for, based on the correction information stored in association with the basis weight information of the corrugated paperboard sheet, correcting the printing timing in each of the printing units and the machining timing in each of the machining units, and causing the printing unit and the machining unit to operate according to the corrected printing timing and the corrected machining timing, respectively.

* * * * *